US012807371B2

(12) United States Patent
Schieder et al.

(10) Patent No.: US 12,807,371 B2
(45) Date of Patent: Nov. 24, 2026

(54) COLLAPSIBLE CONTAINER SYSTEM AND METHOD OF USE

(71) Applicants: Ronald D Schieder, Williamsville, NY (US); Jeffrey D Schieder, Akron, NY (US); Timothy J Schieder, Cherry Hill, NY (US); Daniel J Scheider, Cherry Hill, NJ (US)

(72) Inventors: Ronald D Schieder, Williamsville, NY (US); Jeffrey D Schieder, Akron, NY (US); Timothy J Schieder, Cherry Hill, NY (US); Daniel J Scheider, Cherry Hill, NJ (US)

( * ) Notice: Subject to any disclaimer, the term of this patent is extended or adjusted under 35 U.S.C. 154(b) by 121 days.

(21) Appl. No.: 18/933,113

(22) Filed: Oct. 31, 2024

(65) Prior Publication Data

US 2025/0051056 A1 Feb. 13, 2025

Related U.S. Application Data

(63) Continuation-in-part of application No. 18/084,233, filed on Dec. 19, 2022, now abandoned.

(Continued)

(51) Int. Cl.
*B65D 21/08* (2006.01)
*B65D 25/30* (2006.01)

(52) U.S. Cl.
CPC ..... *B65D 21/086* (2013.01); *B65D 25/30* (2013.01)

(58) Field of Classification Search
CPC ..... B65D 21/086; B65D 25/30; B65D 11/18; A21B 3/131; A01G 9/026; B65F 1/14;

(Continued)

(56) References Cited

U.S. PATENT DOCUMENTS 958,857 A 5/1910 Dennis
3,190,279 A 6/1965 Davis (Continued)

FOREIGN PATENT DOCUMENTS

CN 201668094 12/2010
CN 201734117 2/2011

(Continued)

OTHER PUBLICATIONS

English translation of KR 20150144108 (Year: 2015).*

(Continued)

*Primary Examiner* — Nathan J Jenness
*Assistant Examiner* — Eric C Baldrighi
(74) *Attorney, Agent, or Firm* — AVEK IP, LLC; Christopher M. DeBacker

(57) ABSTRACT

A collapsible container which can be used for a number of purposes. The container can be deployed as a fire pit, as a trash bin, as a planter, or for many other purposes generally suited to containers. The primary function of the invention is to be selectively deployable and collapsible such that it can be taken inside to avoid inclement weather and general deterioration from being stored outdoors. The container is formed from several interlocking pieces or "petals" which fan out from a stored orientation into a deployed orientation forming a container having a container wall surrounding a container base. A central plate can be placed atop the container base to further secure the container in the deployed orientation.

13 Claims, 27 Drawing Sheets

Related U.S. Application Data

(60) Provisional application No. 63/271,200, filed on Dec. 20, 2021.

(58) Field of Classification Search
CPC ..... B65F 2220/1063; B65F 2220/101; B65F 2220/106; B65F 1/02; F24B 1/181; F24B 1/197; F24B 3/00
USPC ..... 220/7
See application file for complete search history.

(56) References Cited

U.S. PATENT DOCUMENTS

| | | | | |
|---|---|---|---|---|
| 4,257,387 | A | 3/1981 | Storandt | |
| D282,998 | S * | 3/1986 | Ransom | 220/8 |
| 5,809,989 | A | 9/1998 | Nelson | |
| 7,263,991 | B2 * | 9/2007 | Schlosser | F24B 1/1808 126/547 |
| 2003/0230298 | A1 | 12/2003 | Klarich et al. | |
| 2004/0261480 | A1 * | 12/2004 | Giesy | C05F 17/907 71/8 |
| 2014/0197178 | A1 * | 7/2014 | Gast | A47G 19/30 220/574 |
| 2015/0041463 | A1 * | 2/2015 | Liu | B65D 11/20 220/4.24 |
| 2019/0078790 | A1 | 3/2019 | Kodila | |
| 2019/0288261 | A1 | 9/2019 | Kim | |

FOREIGN PATENT DOCUMENTS

| | | | | |
|---|---|---|---|---|
| CN | 203493285 | | 3/2014 | |
| CN | 203493285 U | * | 3/2014 | A47G 19/02 |
| GB | 2493108 | | 1/2013 | |
| KR | 20140123760 A | * | 10/2014 | F24B 1/195 |
| KR | 20150144108 A | * | 12/2015 | F24B 1/205 |

OTHER PUBLICATIONS

English translation of CN 203493285 (Year: 2014).*
Screenshot YouTube video clip entitled "Fire Pit [by Rough Country]", 2 pg, uploaded Mar. 8, 2021 by Rough Country. Retrieved from Internet: https://www.youtube.com/watch?v=sSRAAE-vP3M. With pan base halves: https://www.roughcountry.com/product/overland-collapsible-fire-pit-117511c (Year: 2021).*
English translation of KR 20140123760 (Year: 2014).*

* cited by examiner

COLLAPSIBLE CONTAINER SYSTEM AND METHOD OF USE

CROSS-REFERENCE TO RELATED APPLICATION

This application is a continuation-in-part of and claims priority in U.S. patent application Ser. No. 18/084,233, filed Dec. 19, 2022, which claims priority in U.S. Provisional Patent Application Nos. 63/271,200 and 63/271,200, both filed on Dec. 20, 2021, all of which are incorporated herein by reference.

BACKGROUND OF THE INVENTION

1. Field of the Invention

The present invention relates generally to a collapsible container and method for use thereof, and more specifically to a container made of several "petals" which can be selectively deployed or collapsed, where the container is capable of functioning as a fire pit, a trash receptacle, a planter, or other container as needed.

2. Description of the Related Art

Temporary and deployable containers for various purposes are well known and understood; however, the function of these containers are usually singular in purpose and rarely would allow for a device to function as a fire pit and a storage container.

Fire pit containers are used to protect the surrounding area from catching on fire while a fire burns inside the fire pit surrounding. This allows the fire to be contained and not spread into unwanted areas. Fire pit receptacles are used for home entertainment, cooking, camping, and heating purposes.

Fire pit containers are traditionally sizeable and bulky not allowing them to be easily stored or transported. They are also designed to be kept outdoors and exposed to the elements that will breakdown and deteriorate the pit container after sometime.

Similarly, extra trash containers are typically used for parties or entertainment and large outdoor flower pots are typically seasonal in many locations, and require a large amount of storage space while not in use. They are also designed to be kept outdoors and exposed to the elements that will breakdown and deteriorate the surrounding after sometime.

Heretofore there has not been available a system or method for a collapsible container with the advantages and features of the present invention.

BRIEF SUMMARY OF THE INVENTION

The present invention generally provides for a collapsible container which can be used for a number of purposes. The container can be deployed as a fire pit, as a trash bin, as a planter, or for many other purposes generally suited to containers. The primary function of the invention is to be selectively deployable and collapsible such that it can be taken inside to avoid inclement weather and general deterioration from being stored outdoors.

Traditional fire pits for outdoor entertainment and cooking are sizeable and bulky not allowing them to be easily stored or transported. The present invention can serve as a portable fire pit that can collapse into the size of a standard over the shoulder bag for easy transport. The invention details a collapsible fire pit container that can be assembled and disassembled quickly as well as stored in an area with a small footprint. The design includes a number of interlocking sections ("petals") that form a complete enclosure with a plate installed in the center. Once fully assembled, the fire pit container is designed to stand independently.

Similarly, outdoor trash containers for outdoor entertainment and outdoor seasonal flower pots are sizeable and bulky not allowing them to be easily stored or transported. The present invention can function as a portable trash container and/or flower pot that can collapse into the size of a standard over the shoulder bag for easy transport.

The container design includes two main components, the interlocking side pieces and the center plate. The side components include sections that are cut and bent to interlock. The interlocking aspect of the design occurs towards the top of the pit using one of a variety of interlocking elements to ensure each petal is connected to the adjacent petals. Each of the adjacent sections interlock at as the container wall is formed. An optional bottom center pin may be included to keep the interlocking side pieces together during assembly and disassembly. Once all of the interlocking side pieces are interlocked the center pressure plate can be installed. In one embodiment, the center plate provides an outward force on the interlocking side pieces creating a secure wall enclosure.

Disassembly is conducted by removing the center plate, unlocking one of the interlocking side pieces from its adjacent piece(s), and raising the center pin off the ground allowing for the circle to collapse down to approximately the width of a single side piece, plus the depth of the additional side pieces. Each of the interlocking sections are designed to lay overtop of one another once collapsed and utilize a bottom center pin to keep them together as a single unit.

In an embodiment, the center plate can itself be collapsible, having a seam running down its center such that it can be folded in half for easier storage.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

Figure 1:
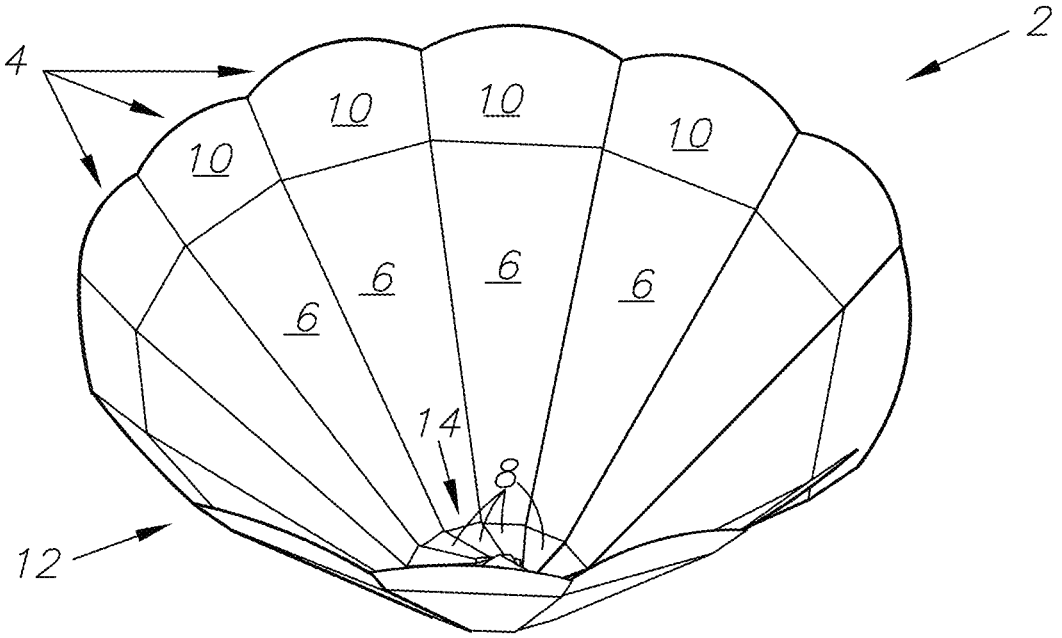
FIG. 1 is a three-dimensional isometric view of a preferred embodiment collapsible storage system shown in a first, deployed orientation.
Figure 2:
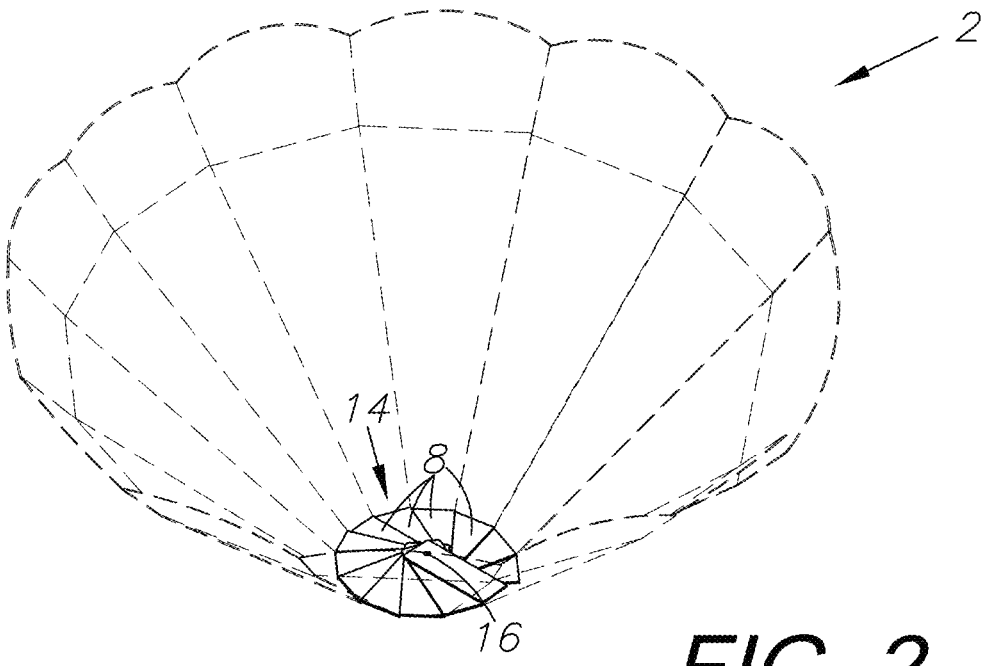
FIG. 2 is a three-dimensional isometric view thereof, wherein the upper portions of the interlocking petal elements are shown in hidden lines.

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

II. Preferred Embodiment Collapsible Container System 2

As shown in FIGS. 1-15, an embodiment of the present invention is a collapsible container system 2 which includes several interlocking petal elements 4 which fan out into a first, deployed orientation from a second, collapsed orientation. Each of the petal elements 4 includes at least a base portion 8 and an upper portion 6, wherein the upper portion may include an additional tip portion 10 which may be at an angle from the upper portion 6. The base portion 8 and the upper portion 6 also form a bend of somewhere between 90 degrees and 175 degrees, such that the base portions 8 of the plurality of petals 4 forms a container base 14, while the upper portion 6 and optional tip 10 fan out into a somewhat circular container wall 12. A central pin hole 16 can receive a pin 30 to ensure the individual petals 4 are in their proper orientation.

Figure 3:
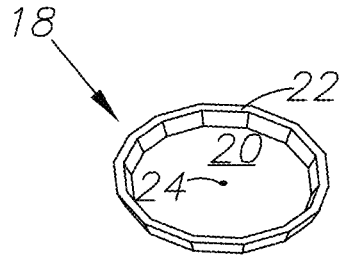
FIG. 3 is a three-dimensional isometric view of a center plate element thereof.
Figure 4:
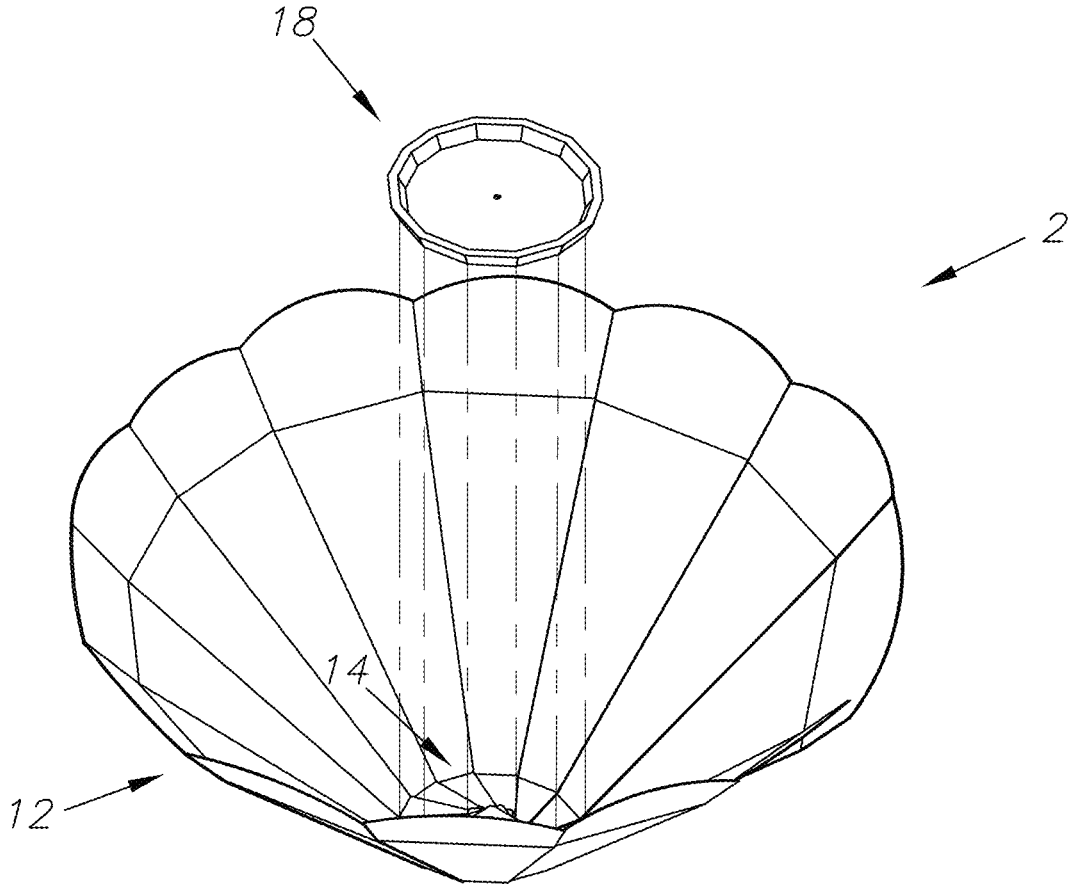
FIG. 4 is a partially-exploded three-dimensional view of the embodiment of FIG. 1 showing the installation of the center plate element of FIG. 3.

FIG. 3 shows a center plate 18 which has a plate base 20, a plate edge 22, and a center receiver 24 which can also receive the pin 30 when fully assembled. FIG. 4 shows the center plate 18 being inserted onto the container base 14. The plate edge 22 pushes out against the interior face of each respective upper portion 6 of each respective interlocking petal 4, keeping the shape of the container wall 12 locked in place.

Figure 5:
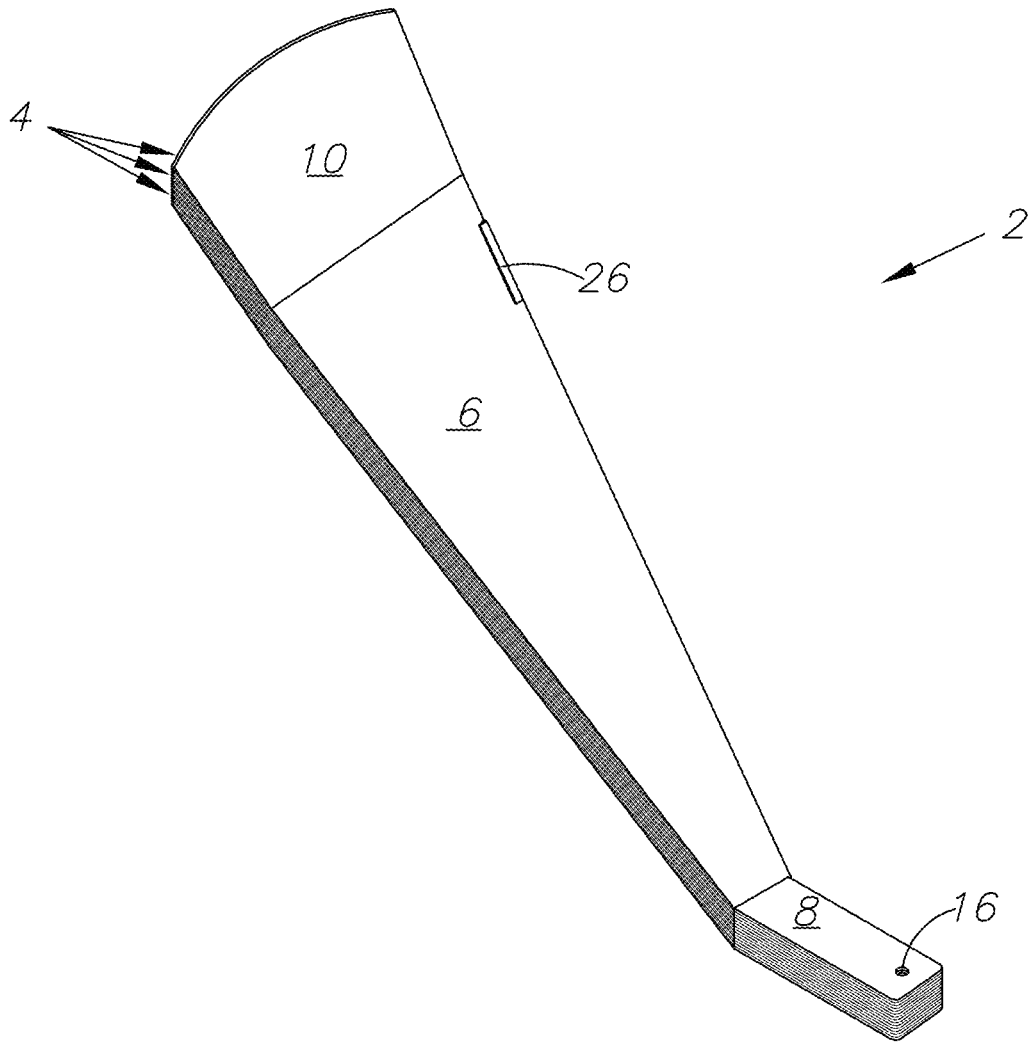
FIG. 5 is a three-dimensional isometric view thereof shown in a second, collapsed orientation.
Figure 6:
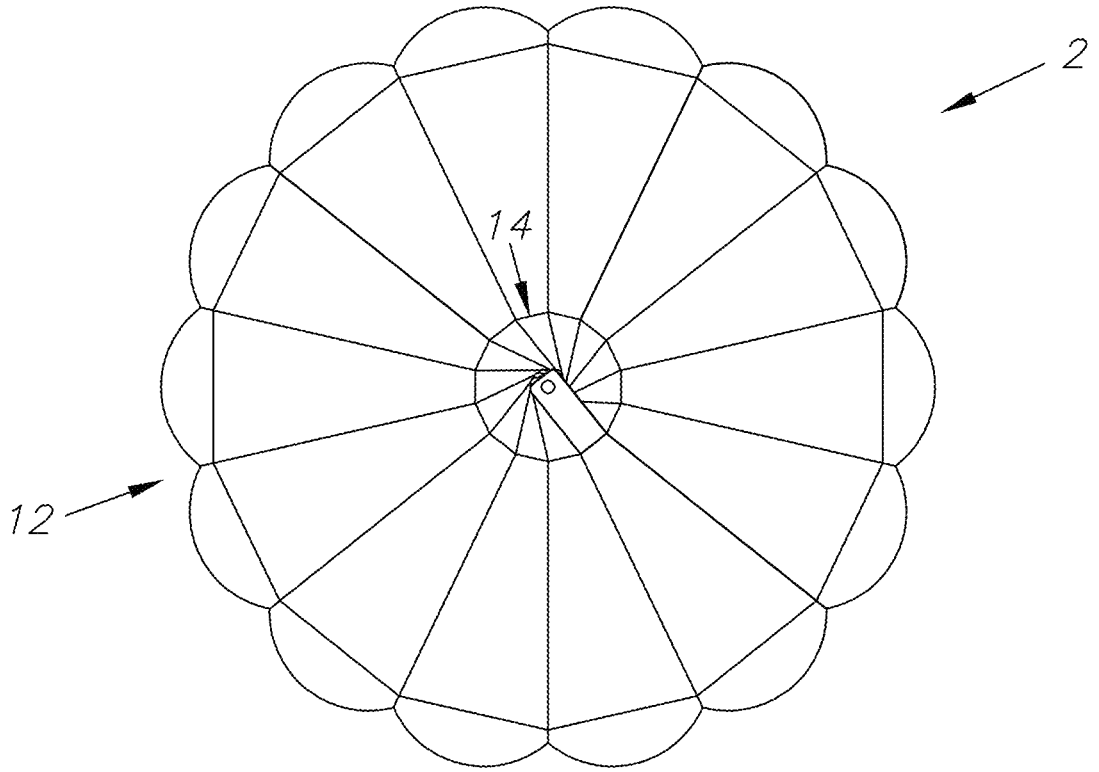
FIG. 6 is a top plan view of the embodiment of FIG. 1.
Figure 7:
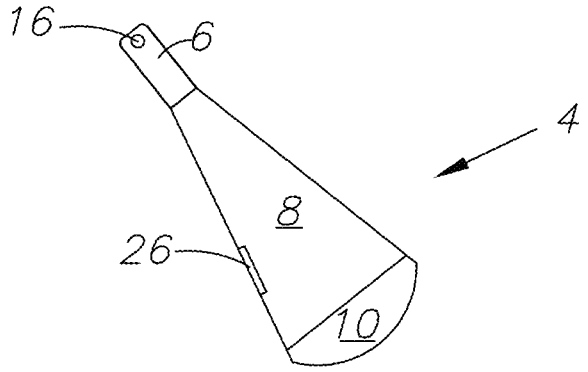
FIG. 7 is a top plan view of a single interlocking petal element thereof.
Figure 8:
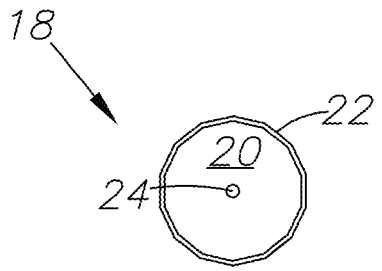
FIG. 8 is a top plan view of the center plate element of FIG. 3.
Figure 9:
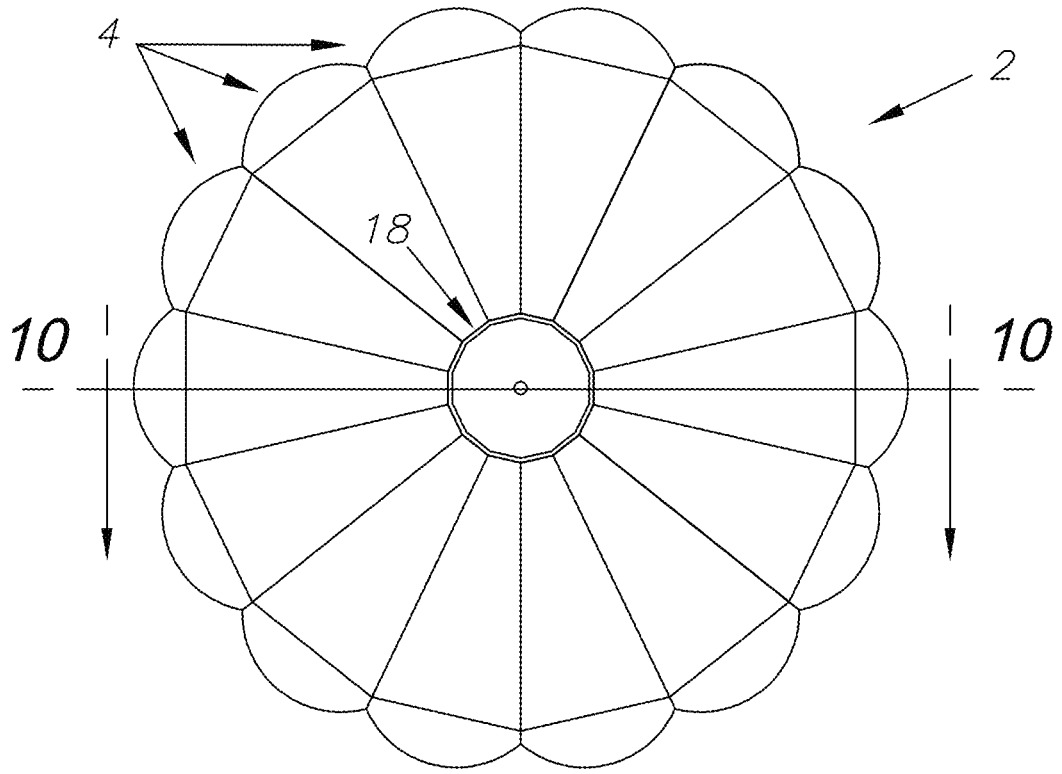
FIG. 9 is a top plan view of the system of Claim 1 including the center plate element installed.
Figure 10:
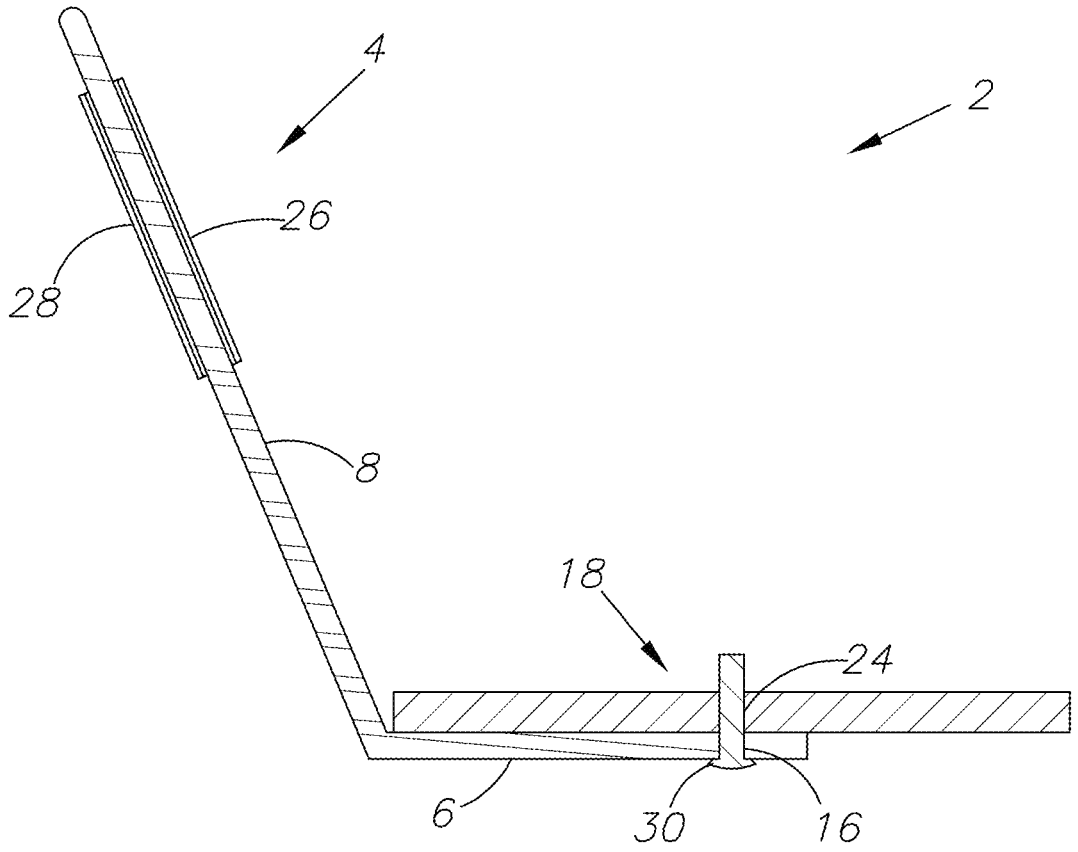
FIG. 10 is a partial sectional view taken about the line of FIG. 9.
Figure 11:
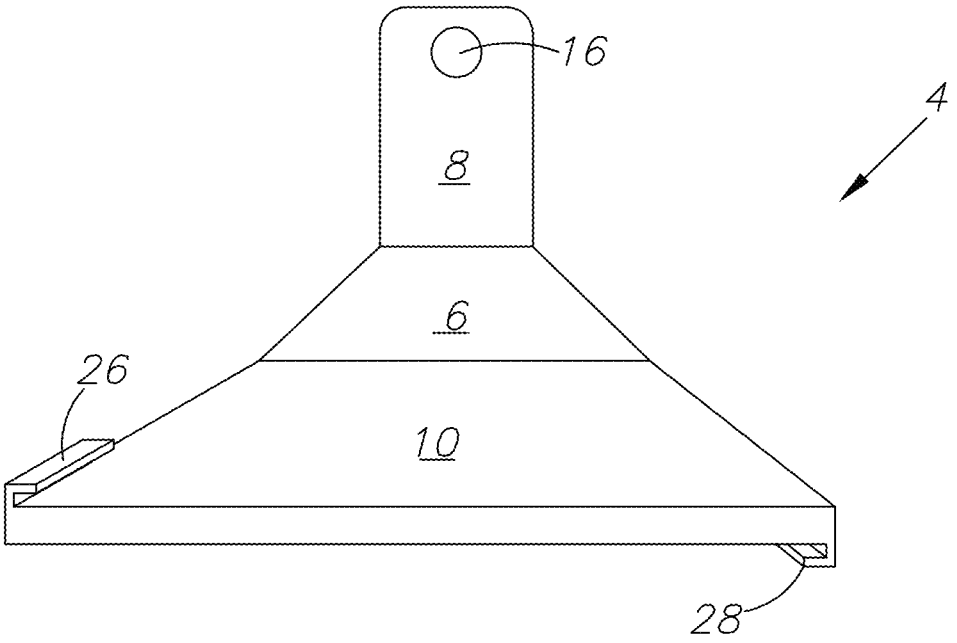
FIG. 11 is a top plan view of an embodiment interlocking petal element.

FIG. 5 demonstrates how the individual interlocking petals 4 can pivot around the central pin hole 16 to overlap, thereby becoming the second, collapsed orientation. In this orientation, the entire assembly takes up a much smaller footprint and can be stored in a bag or easily stored within a closet or other storage container.

Figure 12:
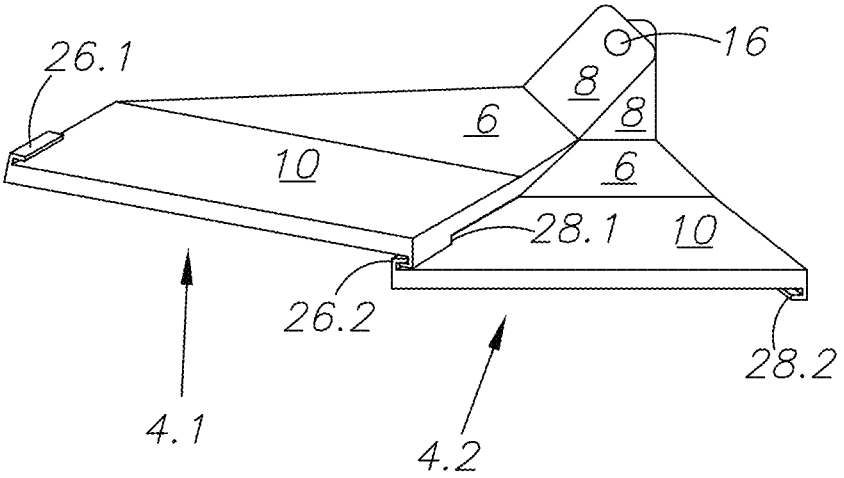
FIG. 12 is a top plan view of two interlocking petal elements thereof.
Figure 15:
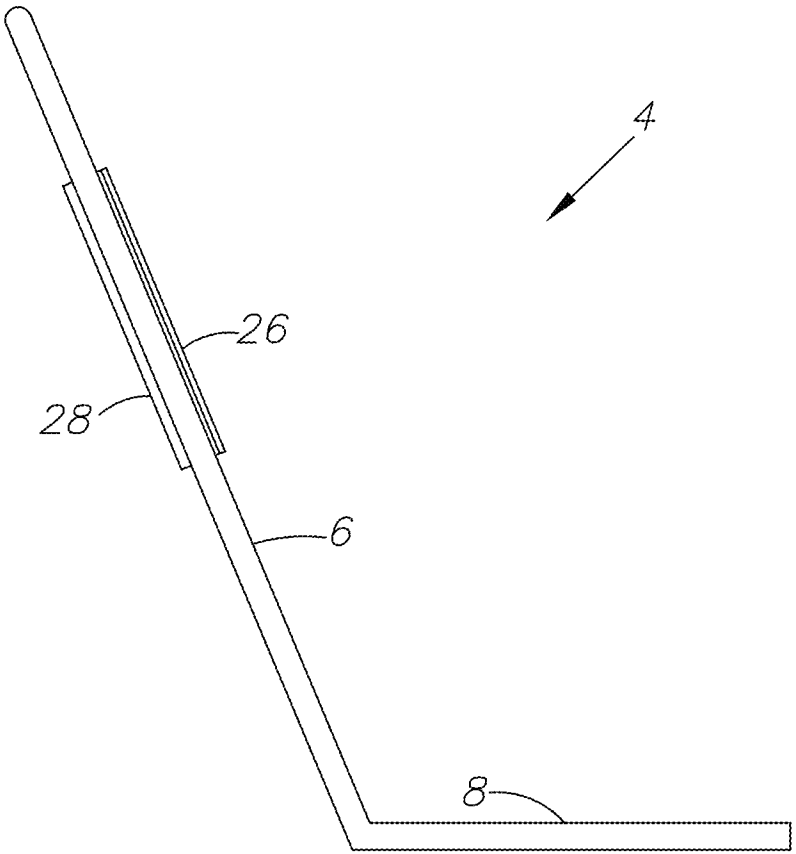
FIG. 15 is a side elevational view thereof.
Figure 14:
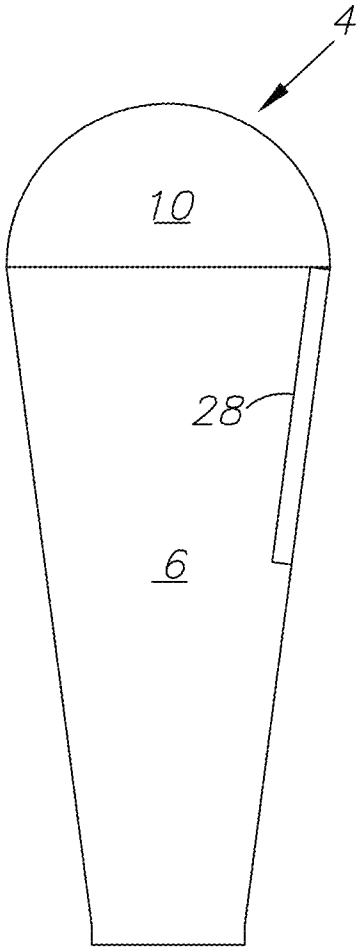
FIG. 14 is a rear elevational view thereof.
Figure 13:
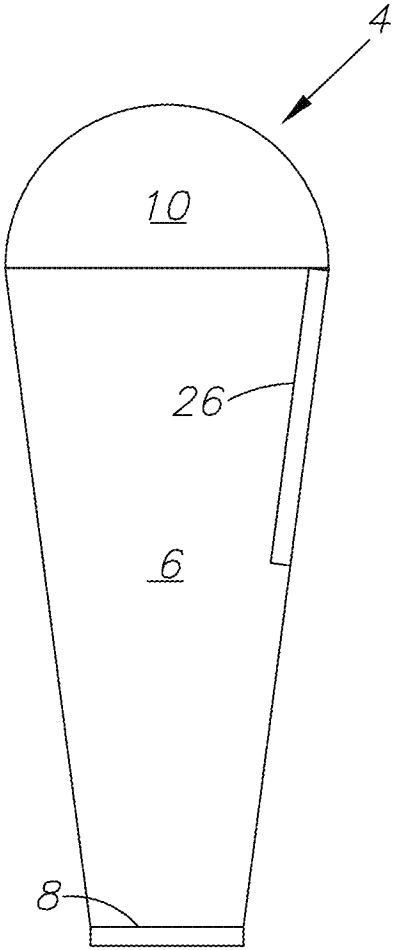
FIG. 13 is a front elevational view of an interlocking petal element.

Each of the interlocking petals 4 has a front connector 26 and a rear connector 28, allowing each interlocking petal to lock with its adjacent petal(s) by locking a petal's rear connector 28 with an adjacent petal's front connector 26. FIG. 12 shows this in detail wherein a first petal 4.1 has a first front connector 26.1 and a first rear connector 26.1, and a second petal 4.2 has a second front connector 26.2 and a second rear connector 28.2. The first rear connector 28.1 of the first petal 4.1 is interlocked with the second front connector 26.2 of the second petal 4.2. This process would continue around the entire container wall. The first petal 4.1 may interlock with the final petal in the chain, or that petal may simply sit adjacent to that final petal as shown in FIG. 1.

Figure 16:
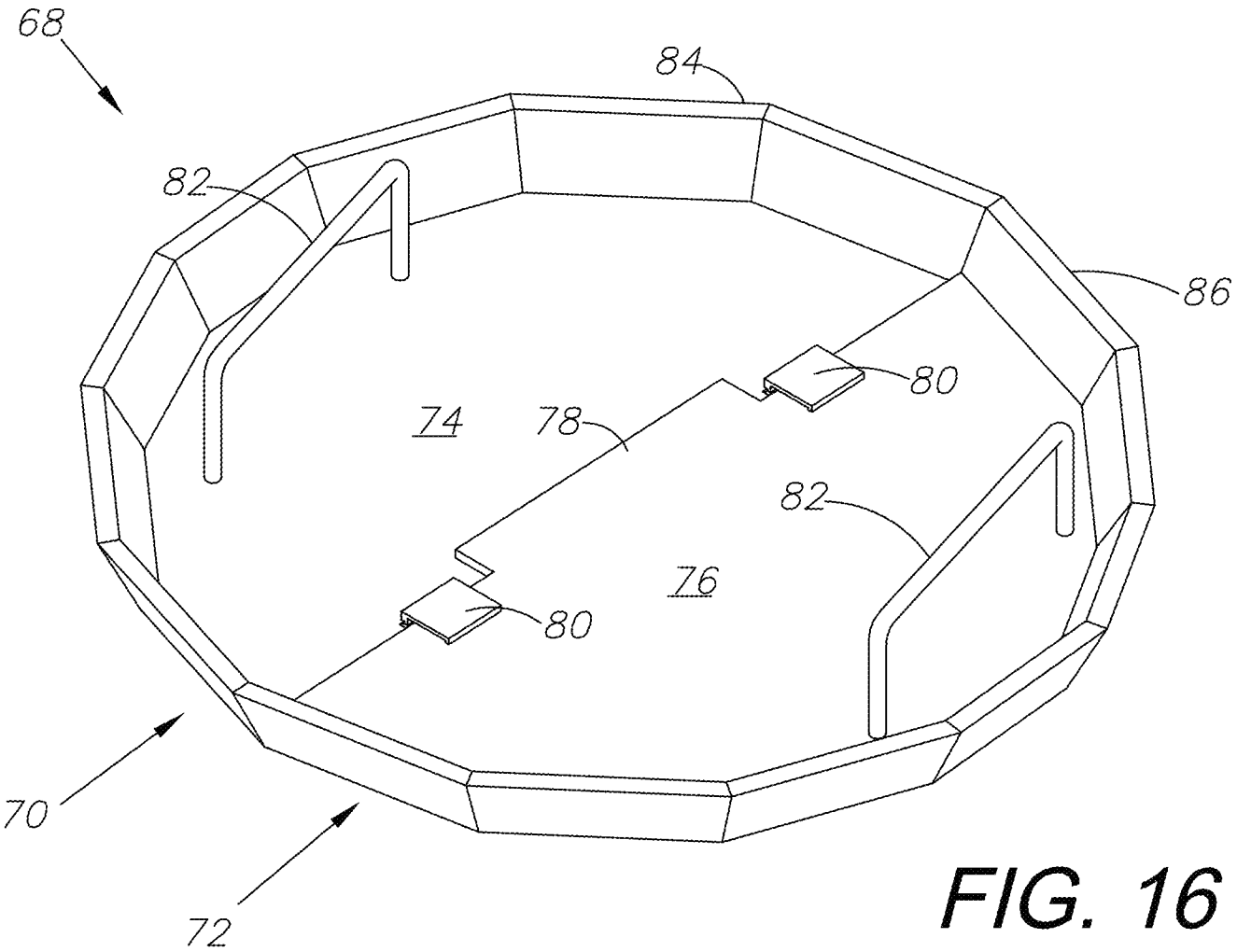
FIG. 16 is a three-dimensional isometric view of an alternative embodiment center plate shown in a first, deployed orientation.
Figure 17:
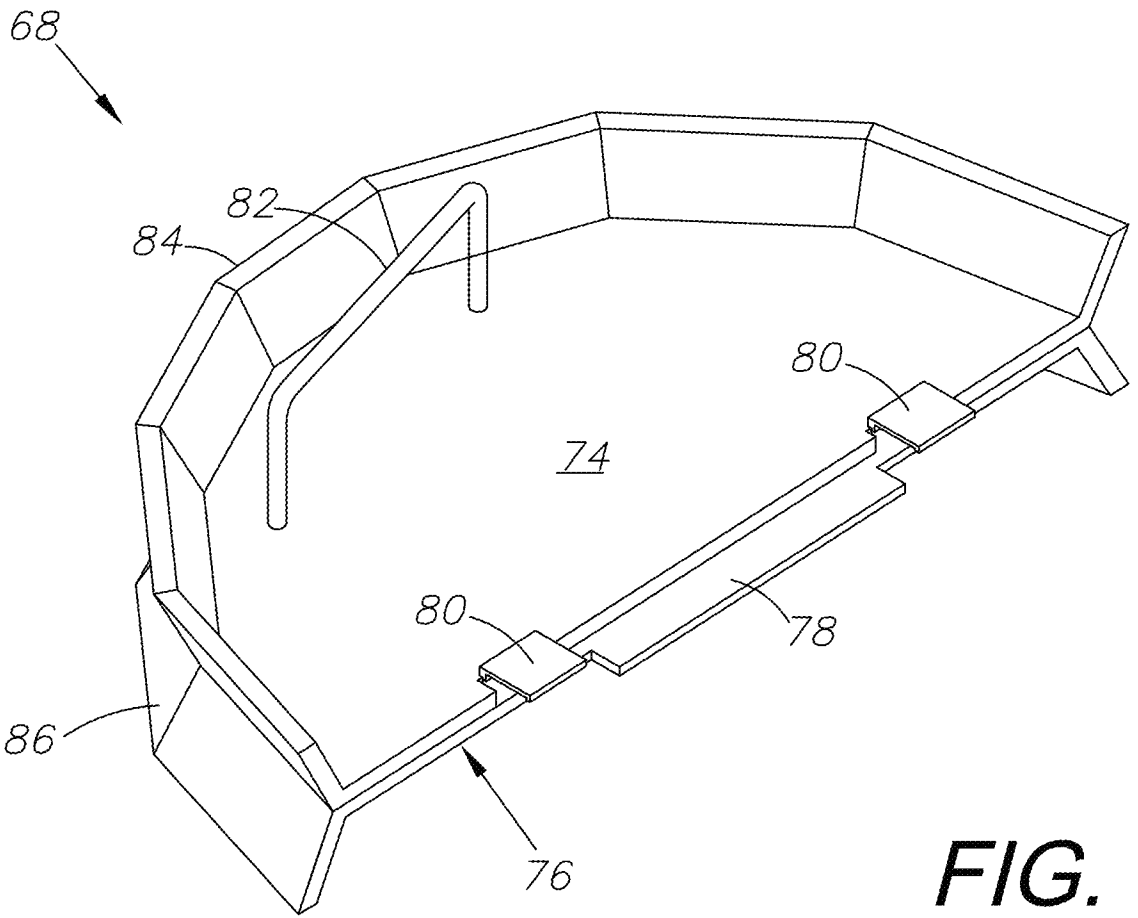
FIG. 17 is a three-dimensional isometric view thereof shown in a second, folded orientation.

FIG. 16 shows an alternative embodiment center plate 68 which has two halves; a first half 70 and a second half 72. These two halves can hinge about the center of the plate 68. The first half has a first plate base 74 and a first plate edge 84. The second half 72 has a second plate base 76 and a second plate edge 86. Each half may include a handle 82 for lifting the plate 68 out of the container system 2. The first half 70 includes some clips 80 which can be used to lock the second half 72 in place in a first, deployed orientation. The second half 72 also includes a tongue 78 which helps to lock the two halves in place and prevents over-rotation about the hinged center. FIG. 17 shows the same center plate 68 in a second, folded orientation for storage.

III. Alternative Embodiment Interlocking Petals 104

Figure 19:
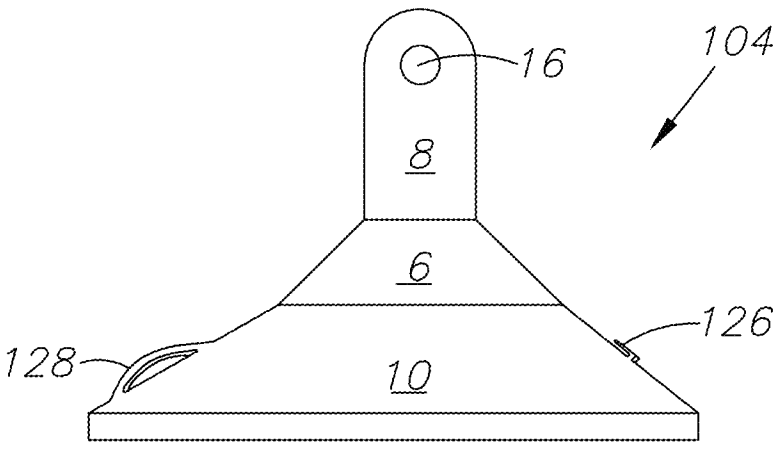
FIG. 19 is a top plan view thereof.
Figure 18:
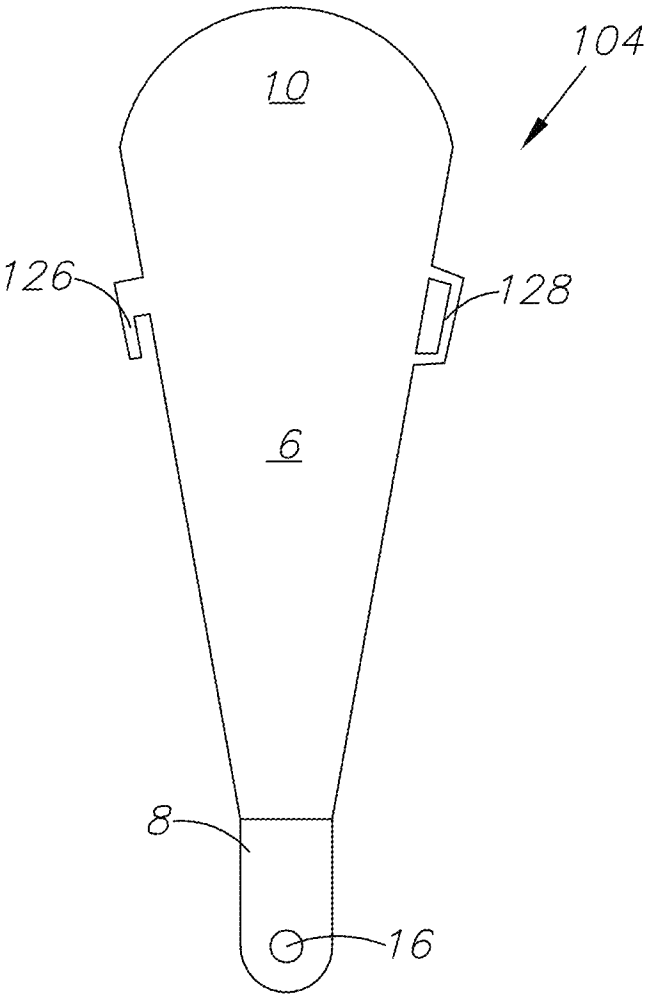
FIG. 18 is a front elevational view of an alternative embodiment interlocking petal element.
Figure 20:
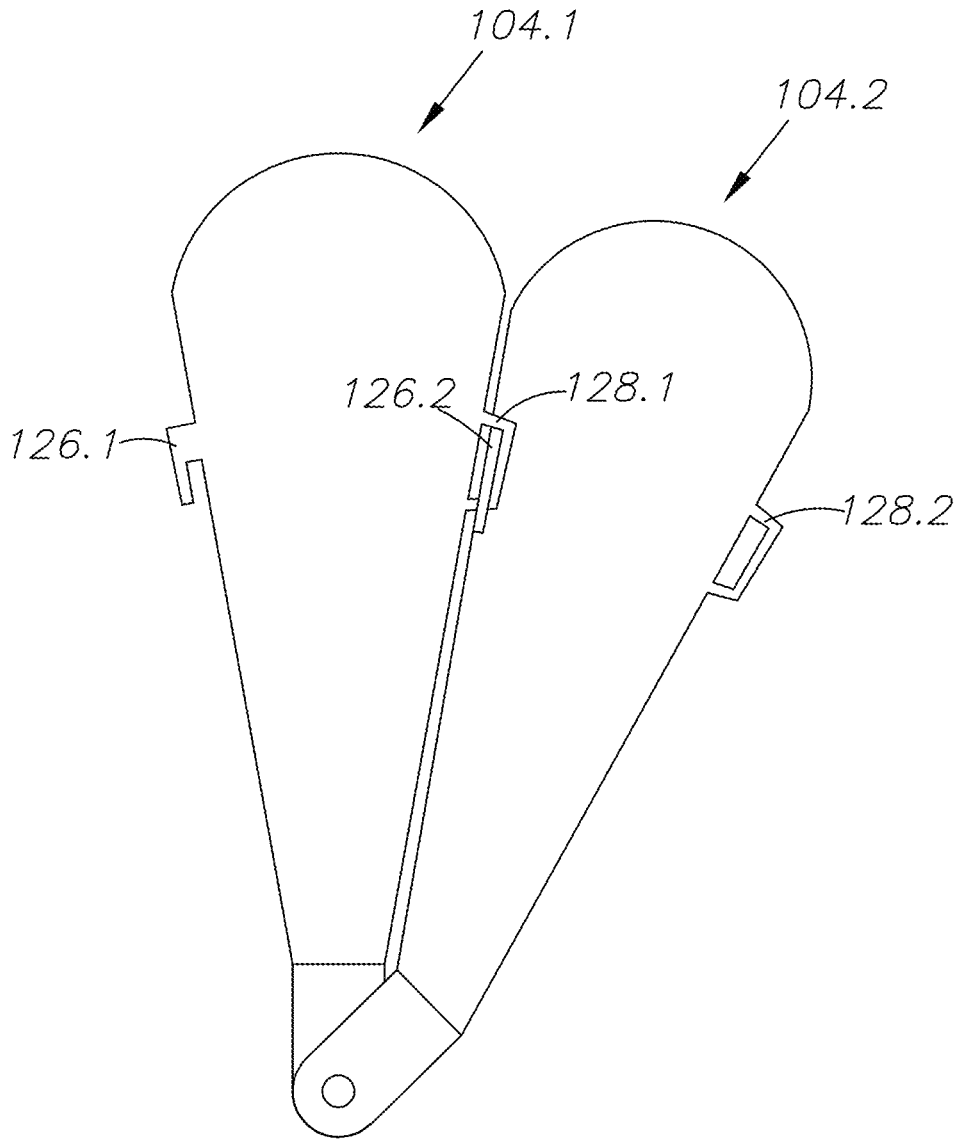
FIG. 20 is a front plan view of two interlocking petal elements thereof.

FIGS. 18-20 show an alternative embodiment interlocking petal 104 which can be used in the same manner as the interlocking petals 4 taught in the previous embodiment. Here, each petal includes an insert connector 126 and a receiver connector 128 forming a type of hook and loop connection between adjacent petals. FIG. 20 shows how a first alternative embodiment interlocking petal 104.1 and a second alternative embodiment interlocking petal 104.2 could use these connectors to interlock. The first petal 104.1 has a first insert connector 126.1 and a first receiver connector 128.1. Similarly, the second petal 104.2 has a second insert connector 126.2 and a second receiver connector 128.2. As shown, the second insert connector 126.2 is inserted through the hole of the first receiver connector 128.1. A before, this process would continue around the entire container wall. The first petal 104.1 may interlock with the final petal in the chain, or that petal may simply sit adjacent to that final petal as shown in FIG. 1.

IV. Alternative Embodiment Interlocking Petals 154

Figure 21:
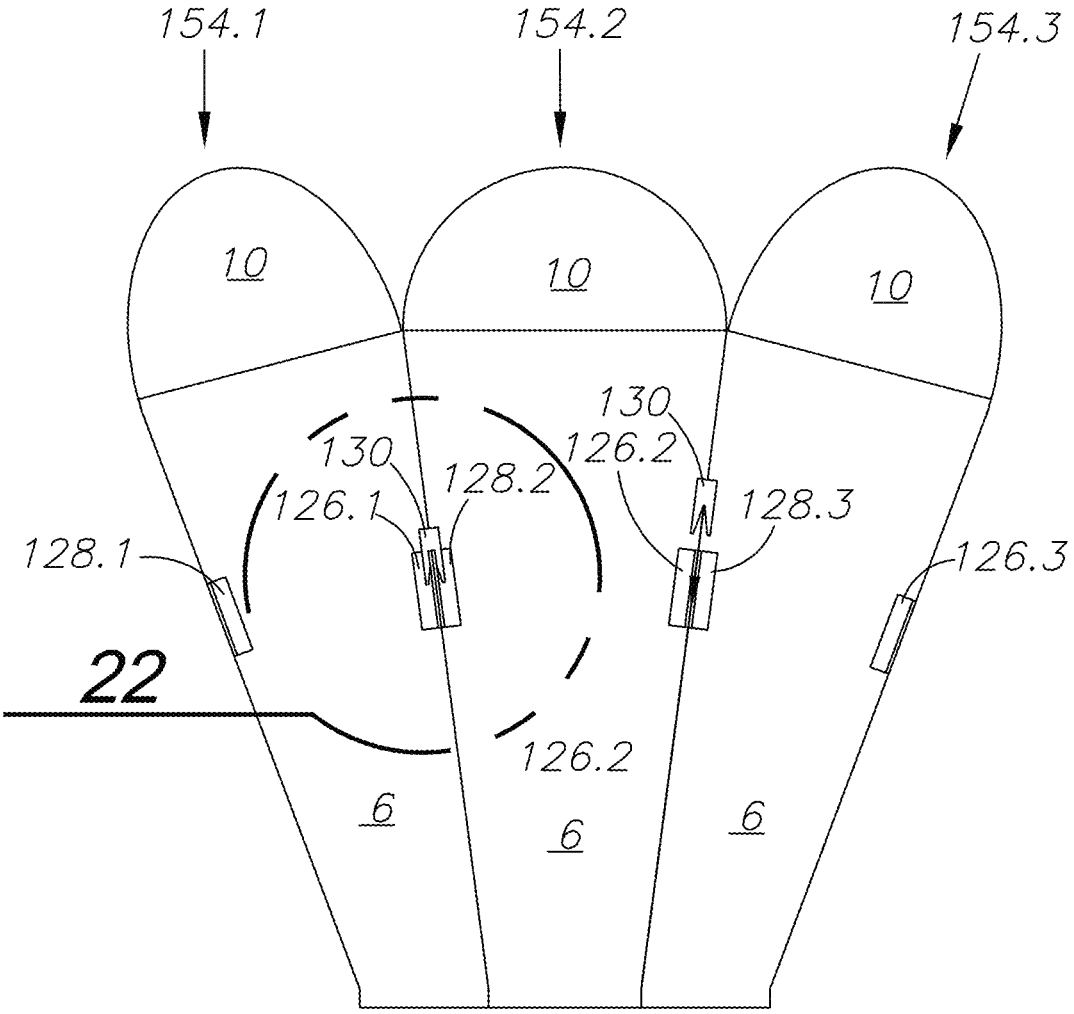
FIG. 21 is a rear plan view of three alternative embodiment interlocking petal elements.
Figure 22:
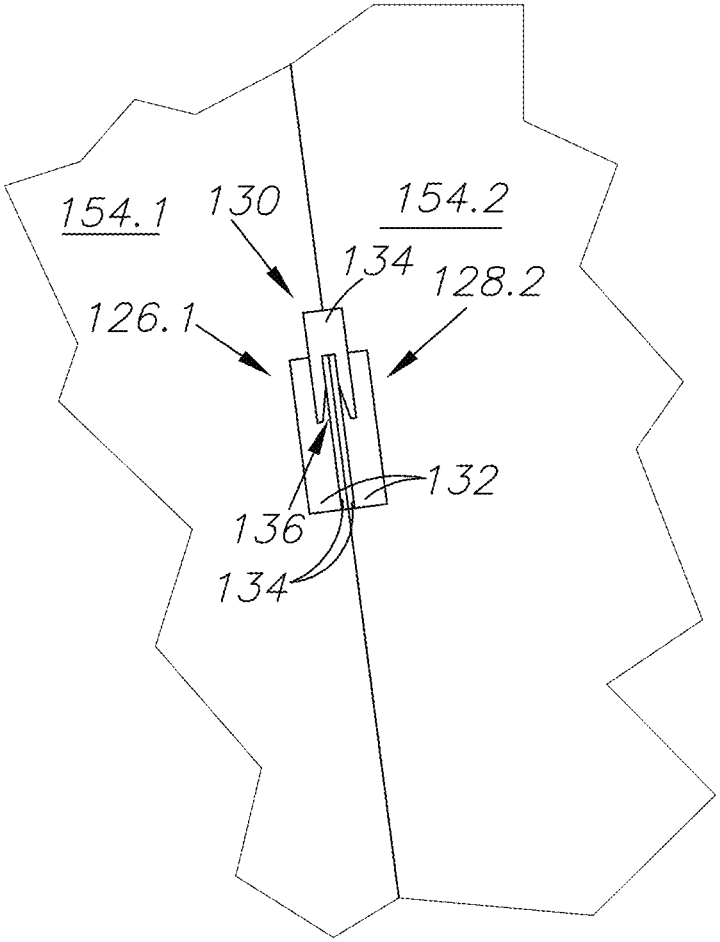
FIG. 22 is a detailed view taken about the circle of FIG. 21.
Figure 23:
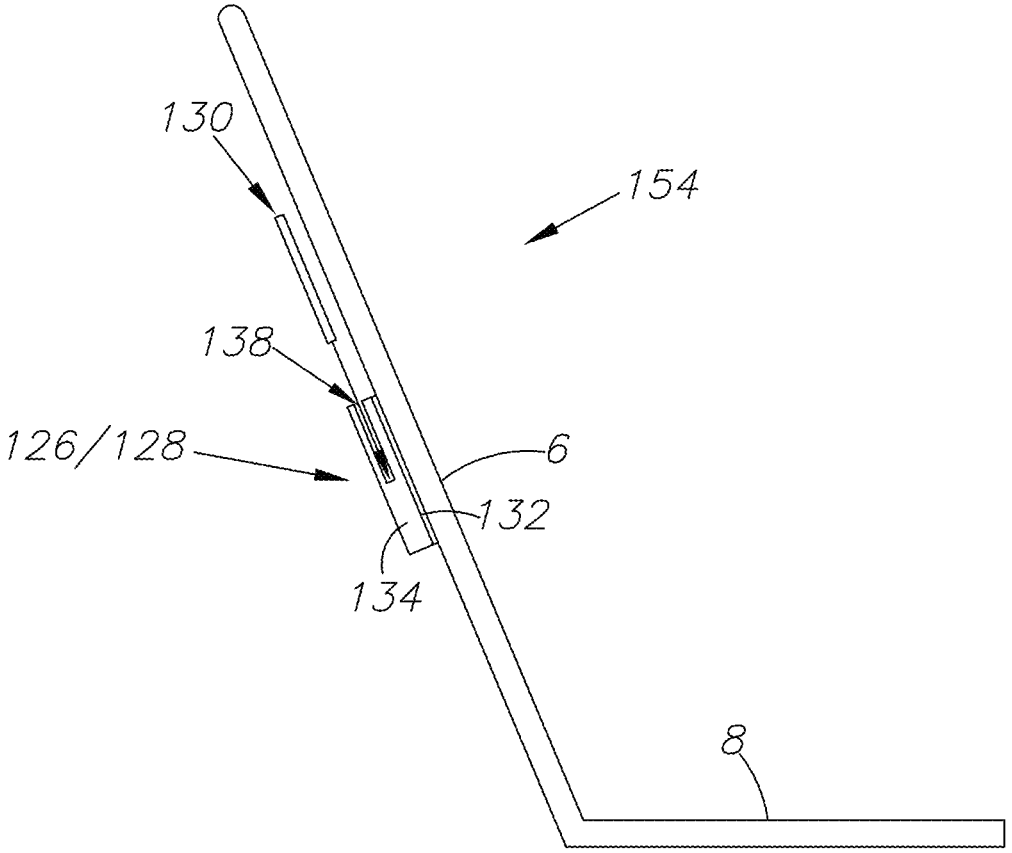
FIG. 23 is a side elevational view of the alternative embodiment interlocking petal element thereof showing the installation of a clip element.
Figure 24:
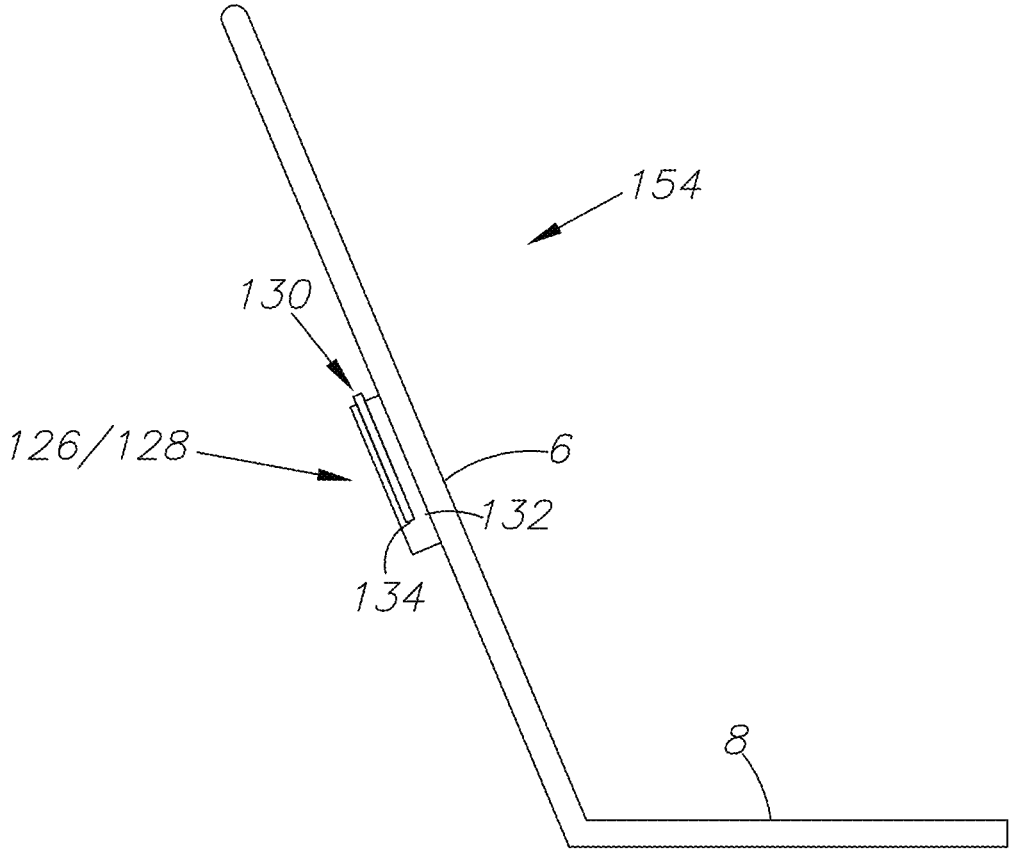
FIG. 24 is a side elevational view thereof wherein the clip element is fully installed.

FIGS. 21-24 show another alternative embodiment interlocking petal 154 which can be used in the same manner as the interlocking petals 4 taught in the previous embodiment. FIG. 21 shows three interlocking petals 154; a first interlocking petal 154.1, a second interlocking petal 154.2, and a third interlocking petal 154.3. The first interlocking petal 154.1 has a first left connector 128.1 and a first right connector 126.1; the second interlocking petal 154.2 has a second left connector 128.2 and a second right connector 126.2; and the third interlocking petal 154.3 has a third left connector 128.3 and a third right connector 126.3.

Each pair of left 128 and right 126 connectors that are adjacent can be secured via a clip 130 which slots into a relief 138 within each of the left 128 and right 126 connectors. The clip 130 can also include a notch 136 which allows the clip to further slot into the relief 138 of the connectors 126, 128. The main body 134 of the clip 130 can be gripped to remove the clip as desired. When slotted into the respective left 128 and right 126 connectors, the clip locks the two adjacent interlocking petals 154 together. Referring to FIG. 21 again, the clip 130 being shown slotted between the second right connector 126.2 of the second interlocking petal 154.2 and the third left connector 128.3 of the third interlocking petal 154.3 will secure the two petals together to form the container wall.

V. Alternative Embodiment Collapsible Container System 202

FIGS. 25-37 show another alternative embodiment collapsible container system 202 capable of performing similar functionality to the previous embodiments. The primary purpose of this embodiment is to provide a portable, collapsible firepit with ash pan 218, but which could be used for any suitable purpose once assembled.

Figure 25:
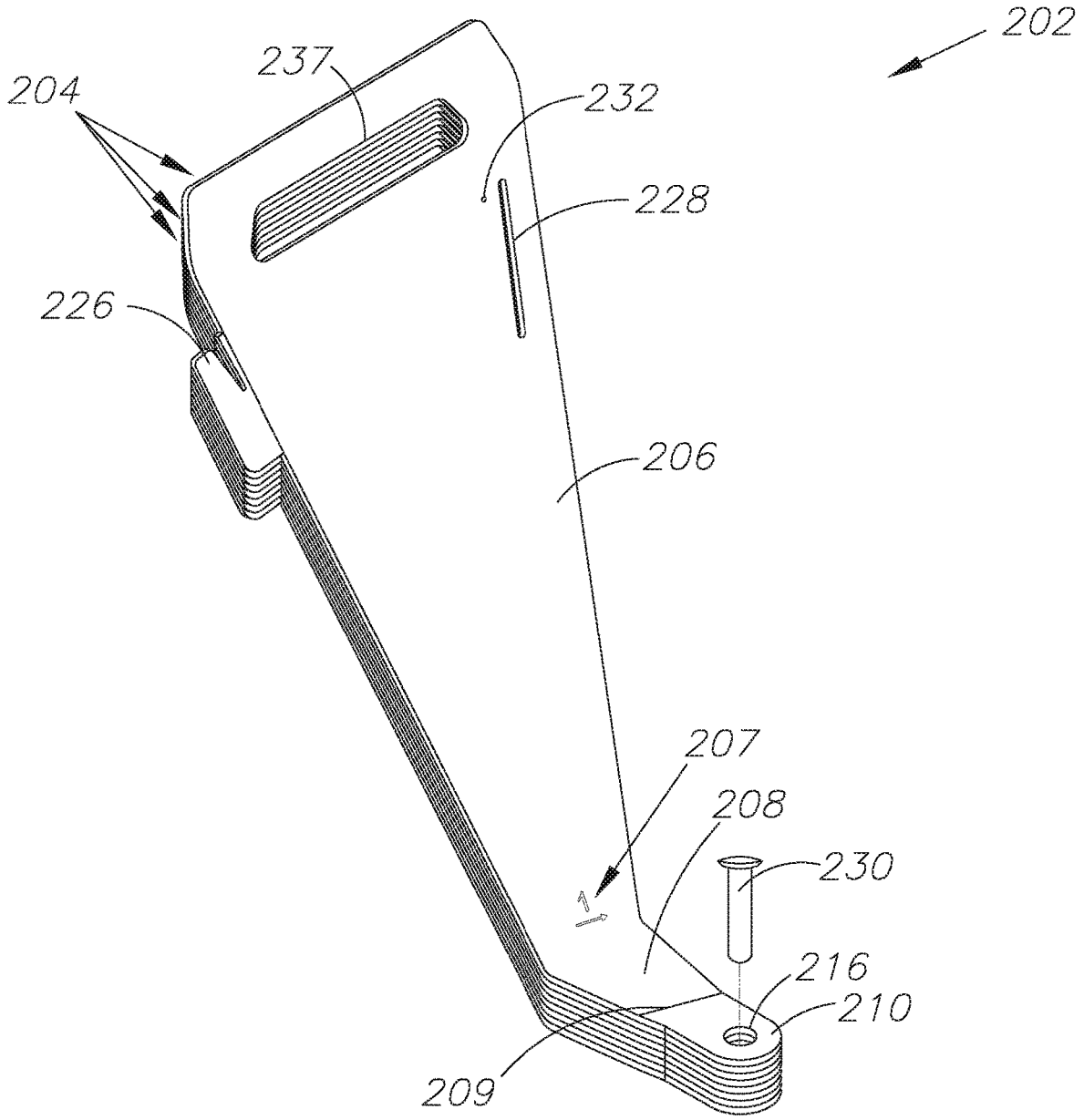
FIG. 25 is a three-dimensional isometric view of an alternative embodiment collapsible container system in a collapsed orientation.

FIG. 25 shows how several interlocking petals 204 can be arranged in a collapsed orientation for storage and transportation. Each petal includes a bottom portion 208 and top portion 206. The bottom portion includes a toe 210 which is further bent 209 from the rest of the bottom portion 208 to allow the petals to rotate about to form the container shown in FIG. 26.

Each petal 204 also includes a central pin hole 216 which can receive a pin 230, bolt, or other element which can hold the stack of petals together.

Each petal may include an indicator 207 which shows the rotation direction and may label each of the petals for identification and to ensure the container system is properly assembled.

Each petal includes a locking tab 226 and a receiver slot 228. The locking tab 226 connects to the petal 204 to the immediate left of the petal containing the locking tab, and is inserted into the receiver slot 228 of that petal to the immediate left. Similarly, the locking tab 226 of the petal to the immediate right will be slotted into the receiver slot 228 of the selected petal.

Each petal may also include a handle 237 for storage and manipulation.

Figure 26:
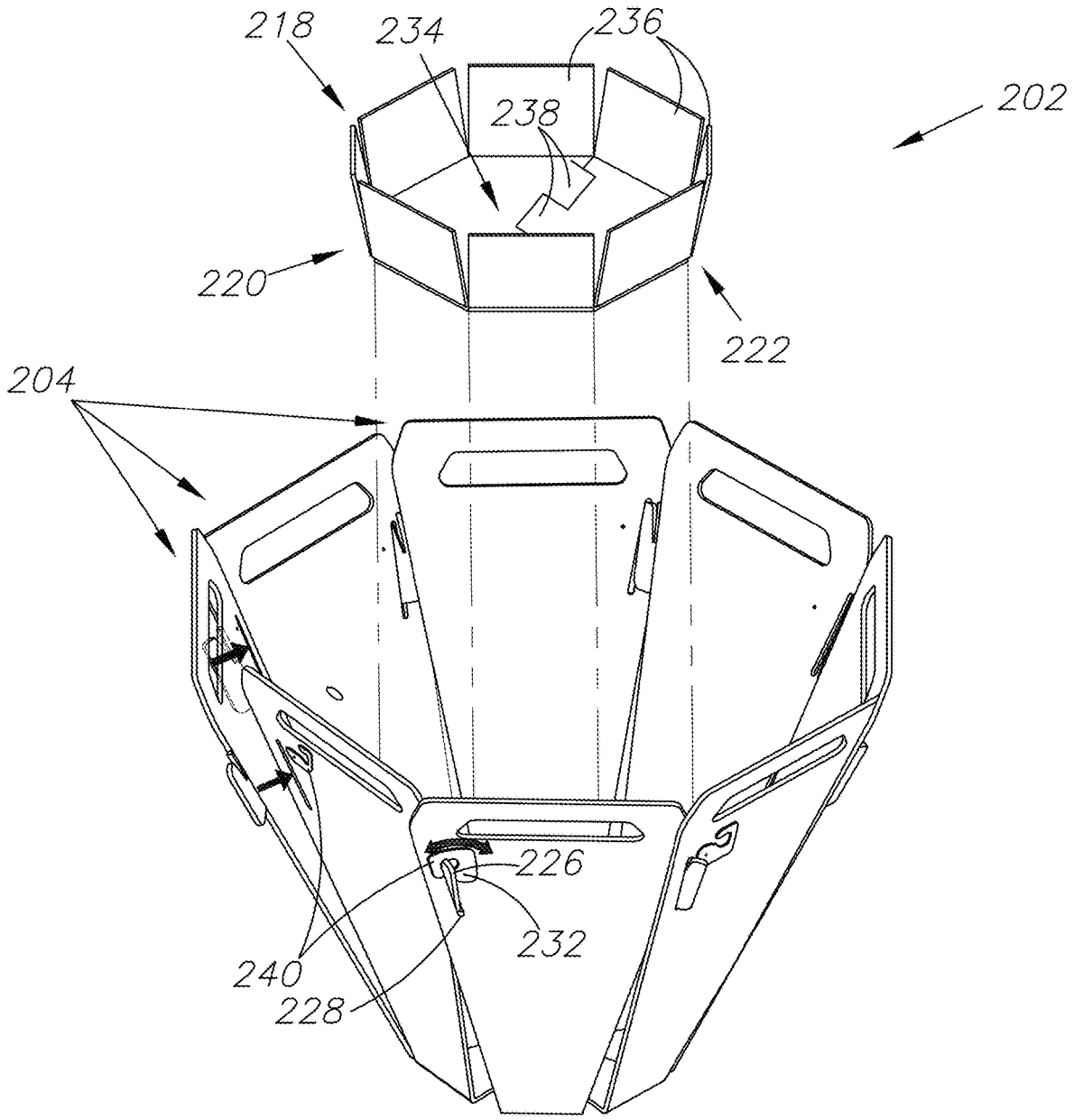
FIG. 26 is a three-dimensional isometric view thereof shown in a deployed orientation.
Figure 27:
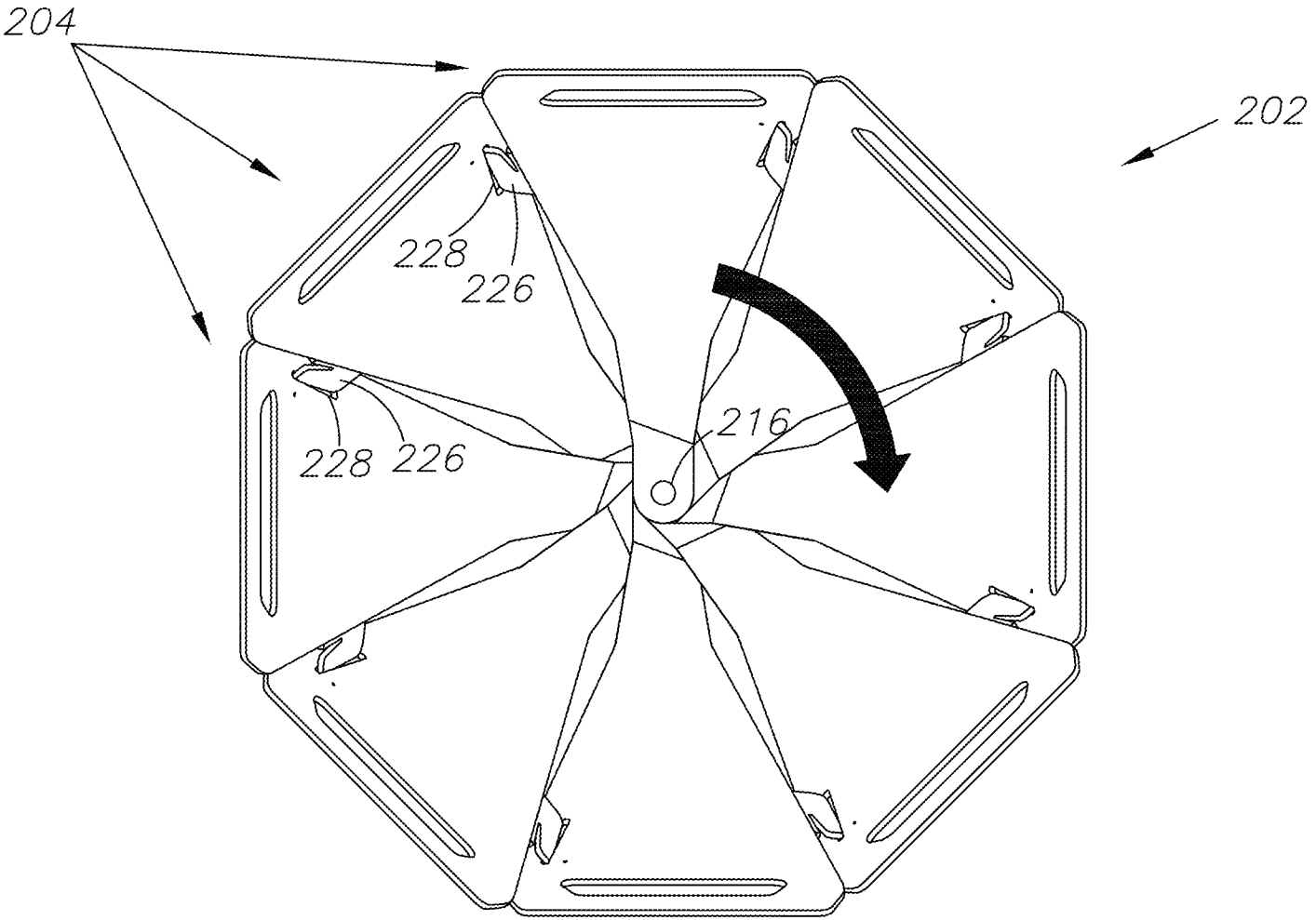
FIG. 27 is a top plan view thereof.
Figure 28:
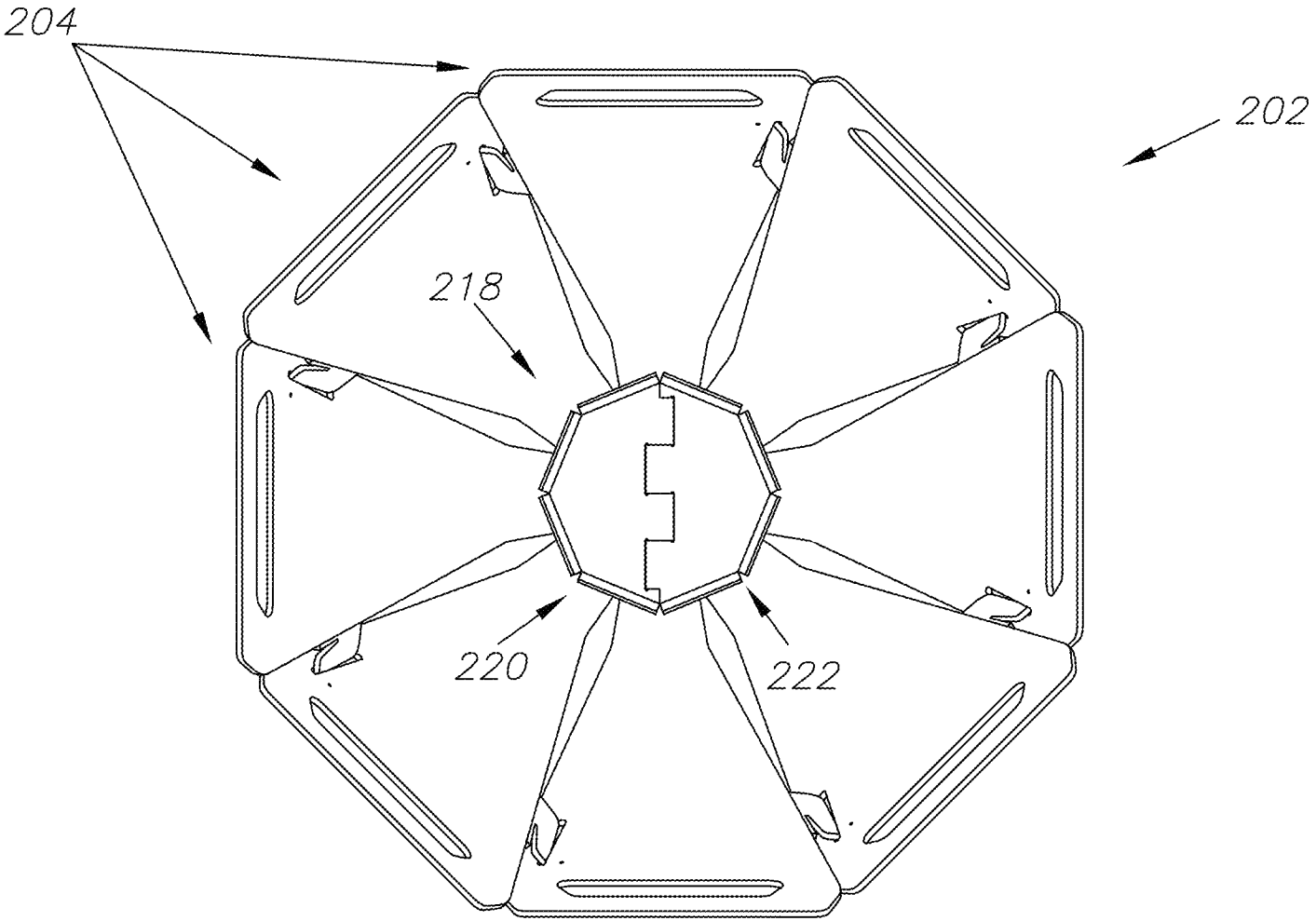
FIG. 28 is another top plan view thereof, showing the ash pan element.
Figure 29:
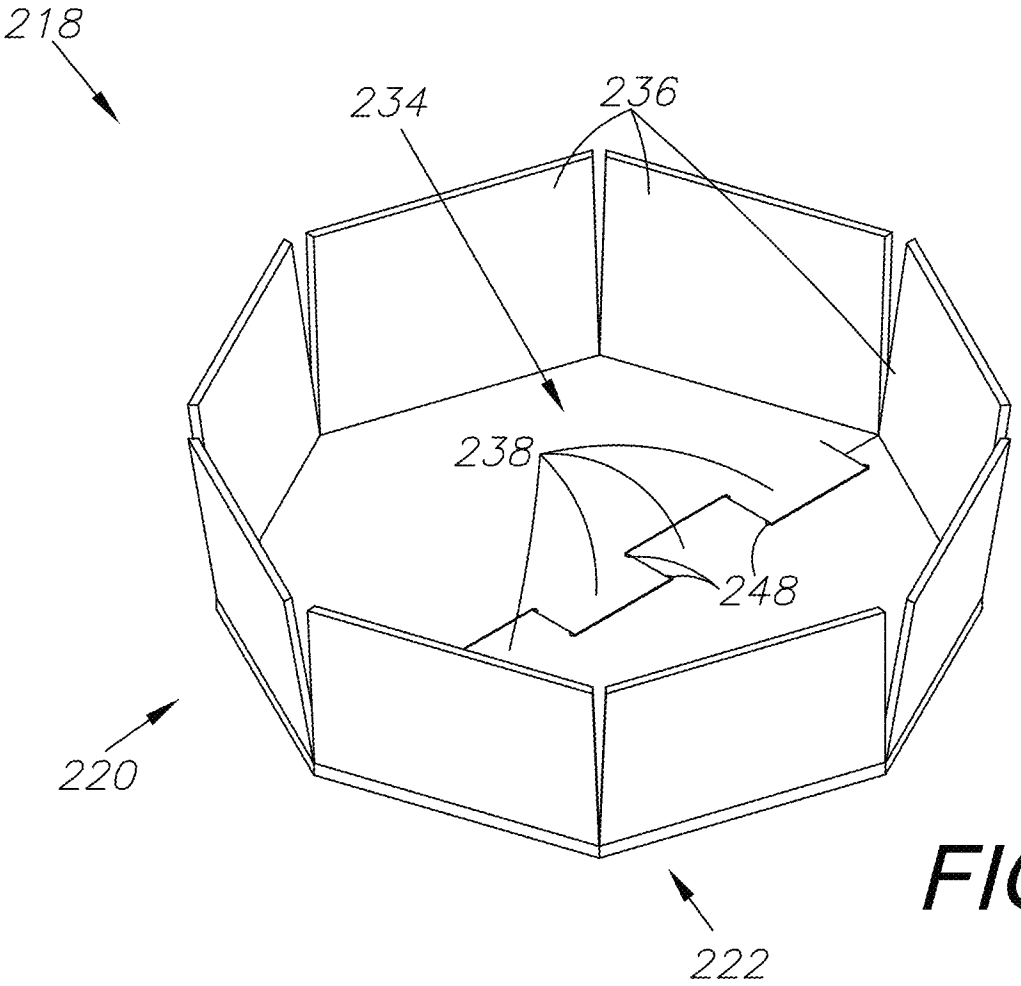
FIG. 29 is a three-dimensional isometric view of the ash pan element thereof shown in an assembled orientation.
Figure 30:
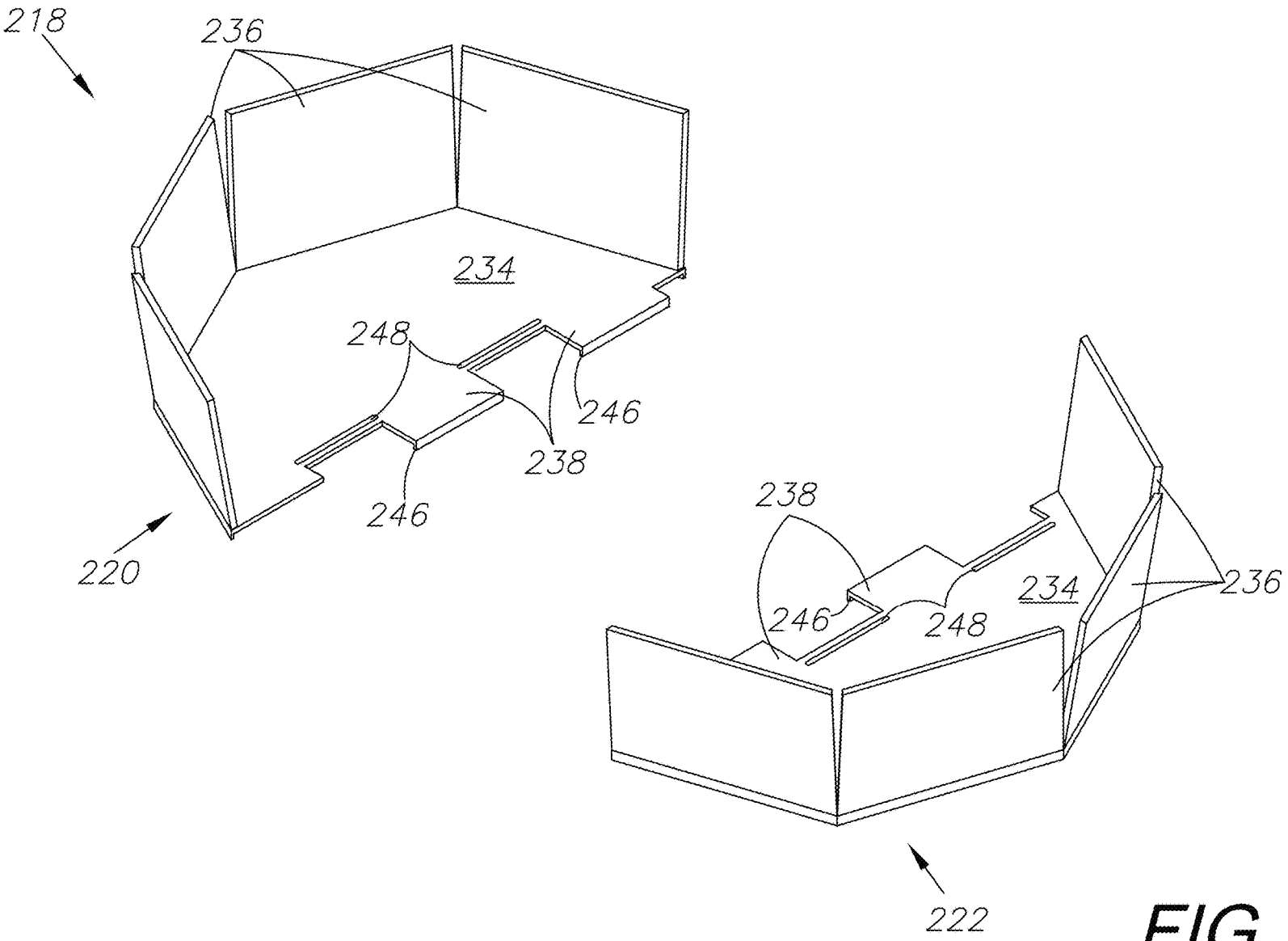
FIG. 30 is a three-dimensional isometric view thereof shown in a separated orientation.

FIG. 26 shows how a latch 240 is pivotally mounted via a connector 232 on each leaf. This latch 240 can rotate to lock the locking tab 226 once inserted into the receiver slot 228 of the respective petal.

FIG. 26 also shows how an ash pan 218 can be placed within the interior formed by the petals 204. The ash pan has a base 234 and raised walls 236. The ash pan can be made of two halves 220, 222 separated by several interlocking leaves 238. FIGS. 29-37 show the ash pan 218 in more detail.

Figure 31:
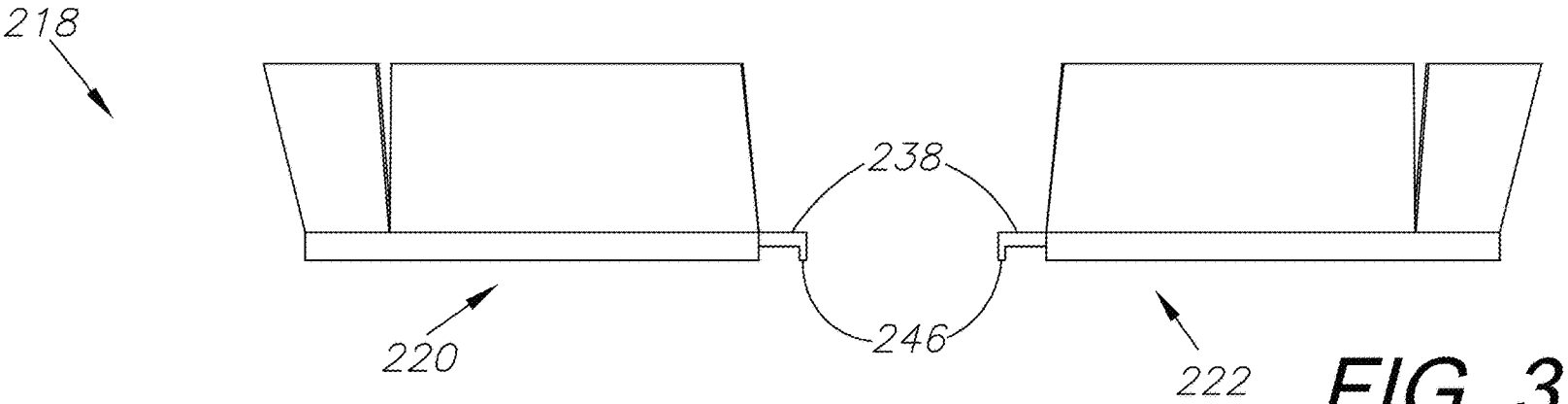
FIG. 31 is a side elevational view thereof.
Figure 32:
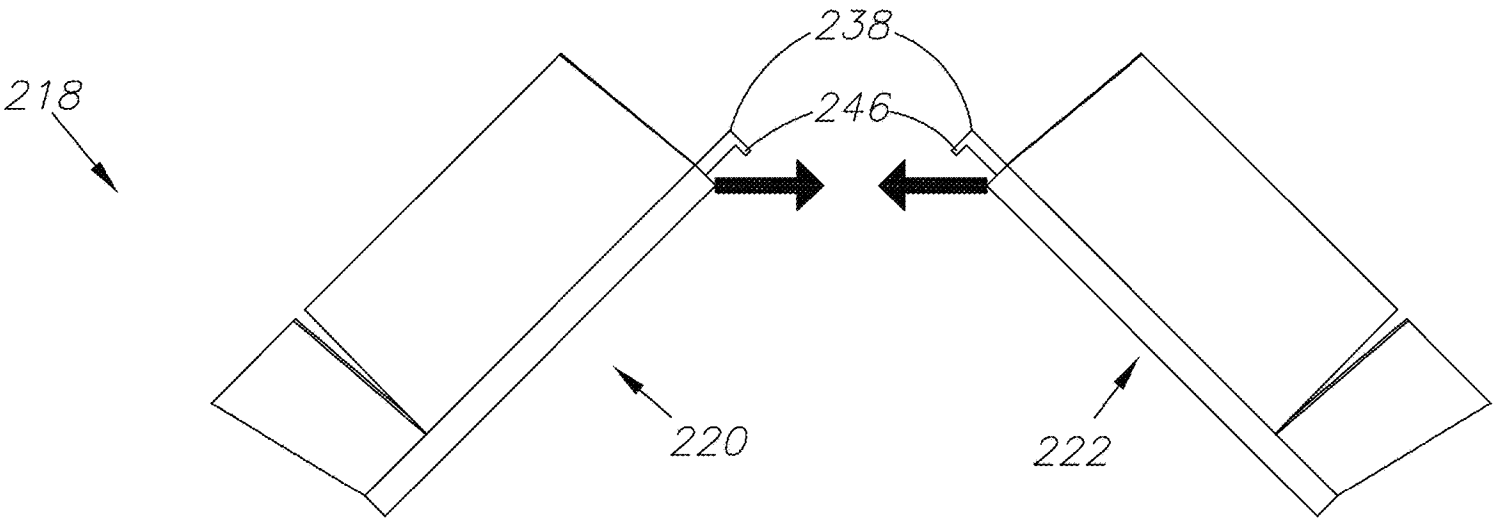
FIG. 32 is a side elevational view thereof, wherein the ash pan element halves are shown angled to connect the two halves.
Figure 33:
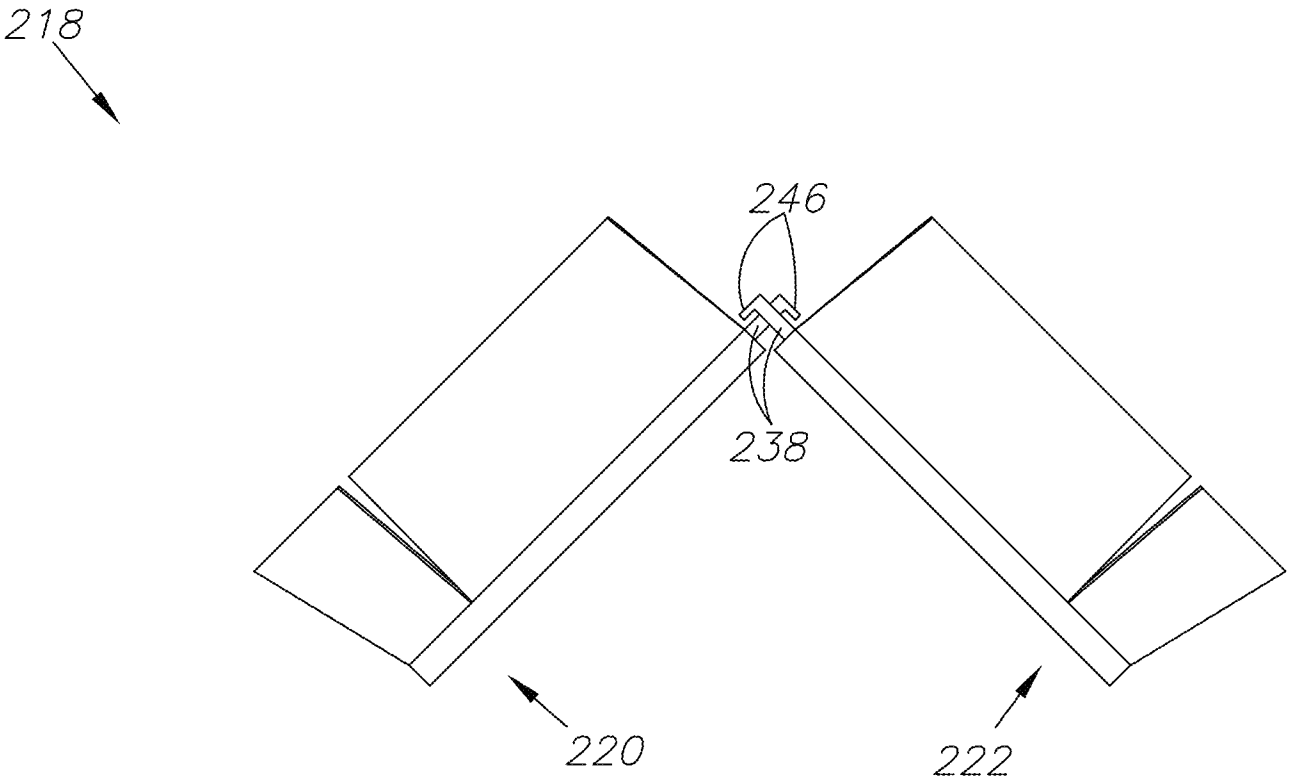
FIG. 33 is another side elevational view thereof showing the two halves being connected.
Figure 34:
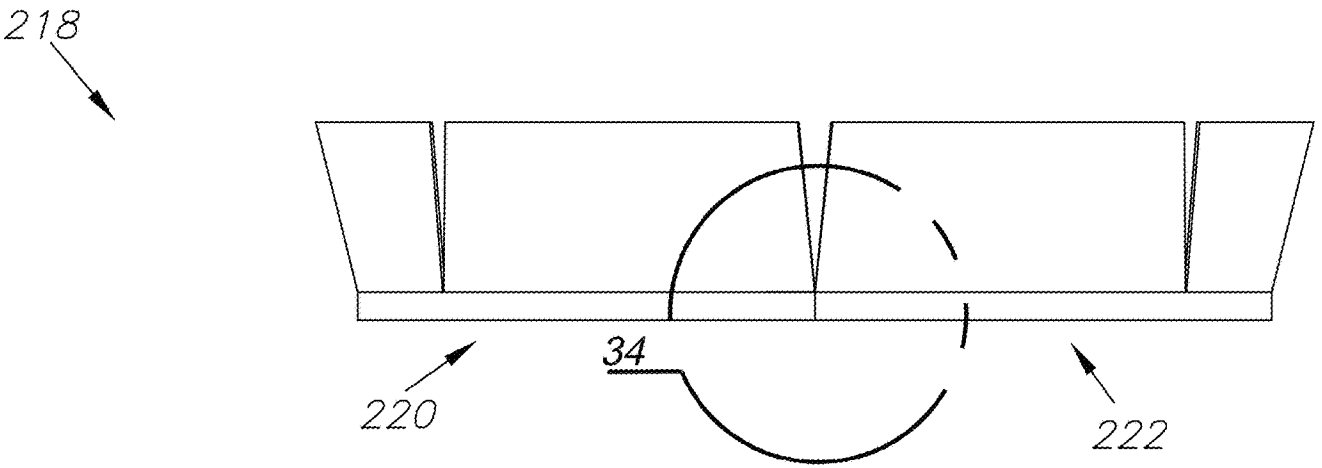
FIG. 34 is a side elevational view thereof shown in the assembled orientation.
Figure 35:
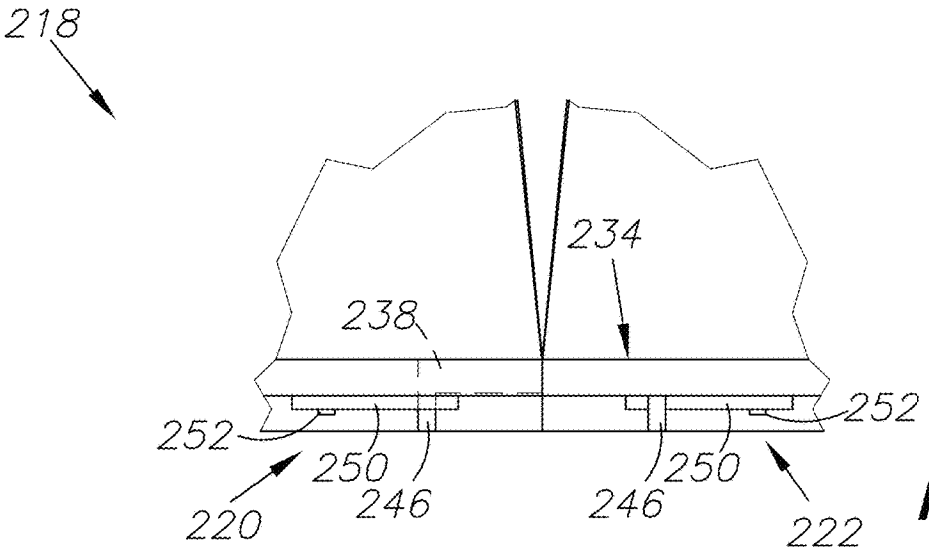
FIG. 35 is a detailed view taken about the circle of FIG. 34.
Figure 36:
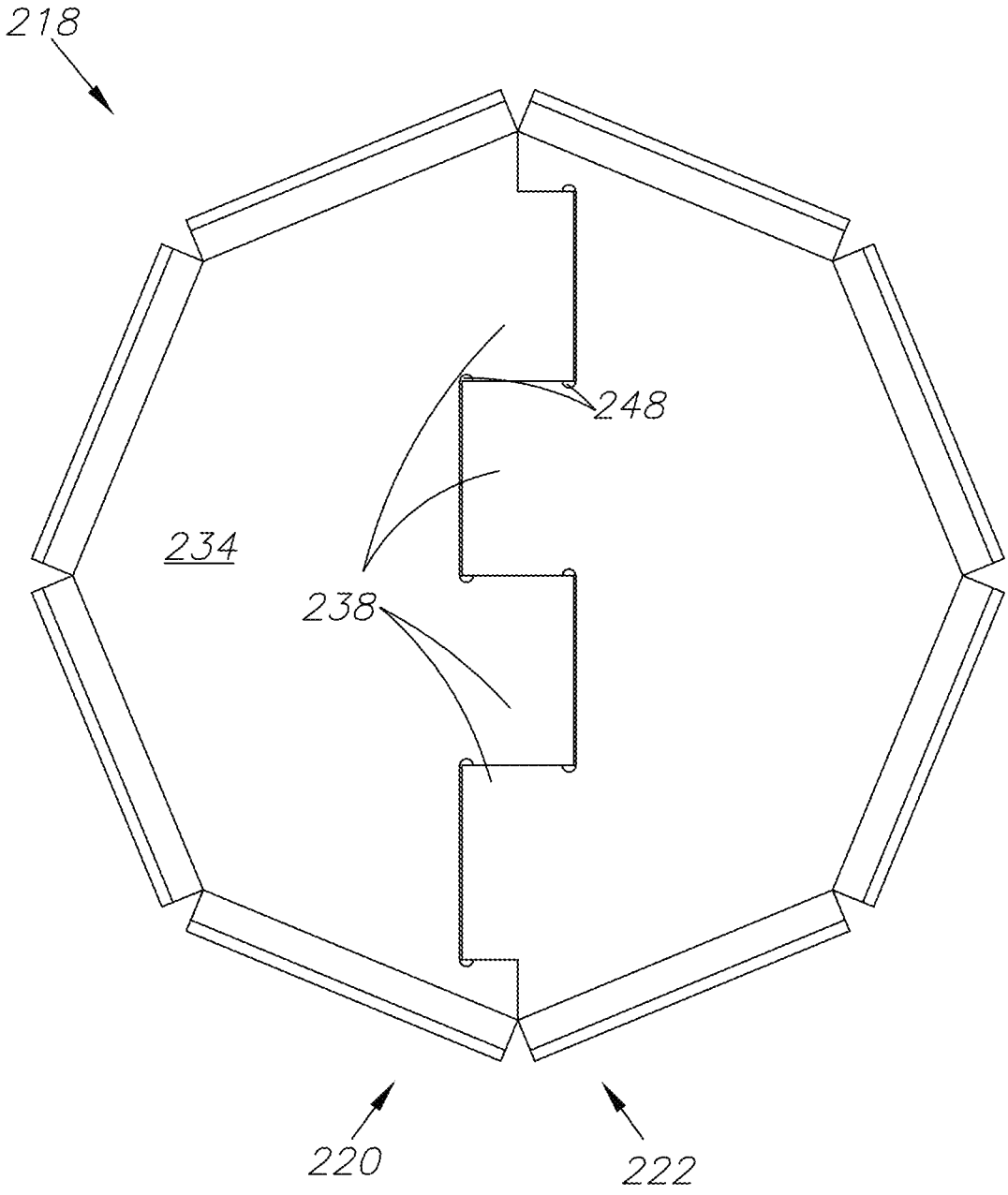
FIG. 36 is a top plan view thereof.
Figure 37:
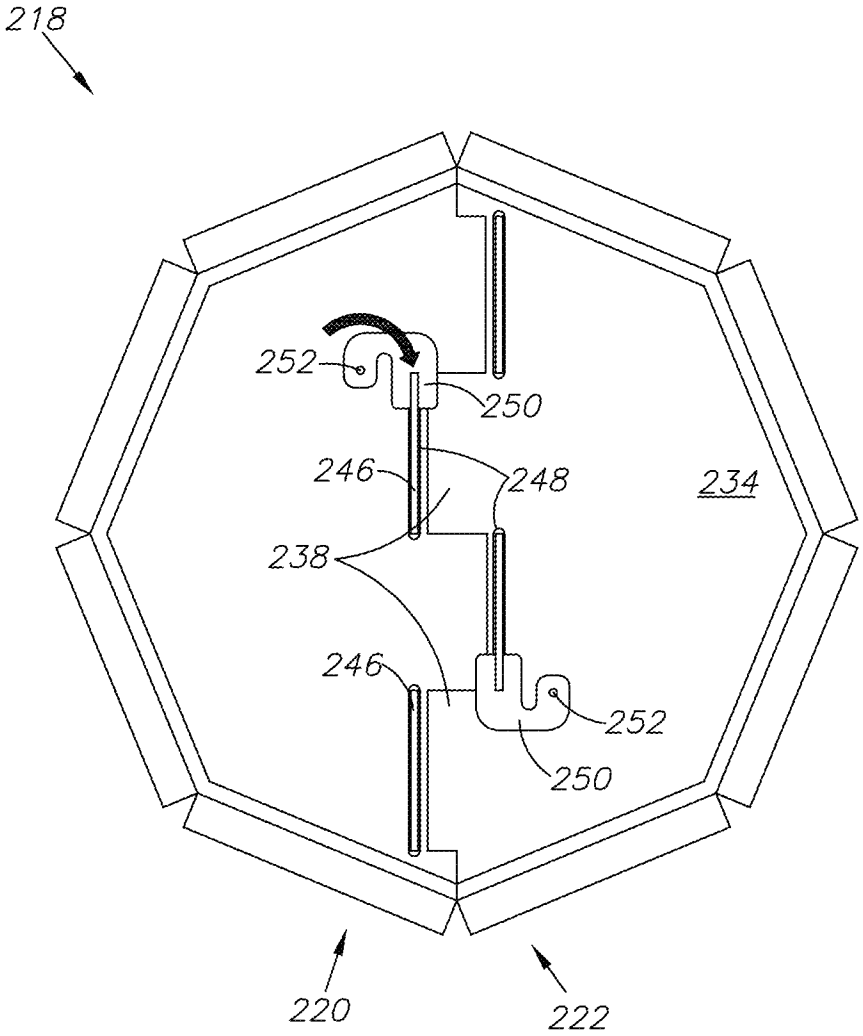
FIG. 37 is a bottom plan view thereof.

Each half 220, 222 of the ash pan 218 includes tab slots 248 which receives the locking tip 246 of a respective interlocking leaf 238. As shown in FIGS. 31-33, the two halves 220, 222 can be connected by placing them together at an angle and rotating the two halves together such that each respective locking tip 246 of each respective interlocking leaf 238 into a corresponding tab slot 248. Once the interlocking tabs are inserted and the ash pan is assembled, latches 250 can pivot about a latch pin 252 beneath the ash pan 218 which connects the two halves 220, 222 together until the latches 250 are released.

It is to be understood that while certain embodiments and/or aspects of the invention have been shown and described, the invention is not limited thereto and encompasses various other embodiments and aspects.

Having thus described the invention, what is claimed as new and desired to be secured by Letters Patent is:

1. A container system comprising:

a container formed from a plurality of interlocking members, each interlocking member comprising a lower portion and an upper portion separated by a first bend of an angle between 45 degrees and 90 degrees;

said plurality of interlocking members configured to be transformed from a first, collapsed orientation wherein said plurality of interlocking members form a stack of interlocking members, to a second, deployed orientation wherein said plurality of interlocking members fan out to form a container having an interior space defined by a container wall formed by the upper portions of said plurality of interlocking members and a container base formed by the lower portions of said plurality of interlocking members;

each of said plurality of interlocking members comprising a leading edge and a prevailing edge, whereby each respective said leading edge includes a locking tab;

each of said plurality of interlocking members comprising a receiver slot in proximity to each respective said prevailing edge, whereby each said receiver slot is configured to receive a respective said locking tab from the respective neighboring interlocking member, such that when said plurality of interlocking members is transformed into said second, deployed orientation, each respective locking tab is inserted into the neighboring respective receiver slot, thereby securing said plurality of interlocking members into said deployed orientation;

a pan comprising a base and a number of sides equaling the number of said plurality of interlocking members, said pan configured to be placed within said container base once said plurality of interlocking members is transformed into said second, deployed orientation such that each corresponding side of said pan nests against a respective side of said plurality of interlocking members; and wherein at least two of each respective one of said plurality of interlocking members includes a respective a handle comprising a hole passing through said respective interlocking member, such that when said plurality of interlocking members is in said first, collapsed orientation, each respective hole is aligned.

2. The container system of claim 1, wherein said upper portion comprises a first portion and a second portion separated by a second bend of an angle between 1 degree and 10 degrees.

3. The container system of claim 1, further comprising:

a latch located on an exterior face of each respective one of said plurality of interlocking members; and said latch configured to secure the respective locking tab of said neighboring interlocking member into said receiver slot.

4. The container system of claim 1, wherein each respective one of said plurality of interlocking members comprises an identifier located on an exterior face thereof.

5. The container system of claim 4, wherein said identifier comprises a number identifying a position of each respective one of said plurality of interlocking members relative to the remaining plurality of interlocking members.

6. The container system of claim 4, wherein said identifier comprises an arrow indicating the direction for fanning out said plurality of interlocking members form said first, collapsed orientation to said second, deployed orientation.

7. The container system of claim 1, further comprising:

each one of said plurality of interlocking members comprising a pin hole located within each respective said lower portion;

a pin configured to pass through each said pin hole; and wherein said plurality of interlocking members are configured to fan out and pivot around said pin.

8. The container system of claim 1, further comprising:

said pan comprising a first half and a second half;

said first half of said pan comprising an interlocking leaf and a tab slot;

said second half of said pan comprising an interlocking leaf and at a tab slot; and whereby said first half and said second half of said pan are configured to be joined by interlocking said at interlocking leaf of said first half with said interlocking leaf of said second half, such that said interlocking leaf of said first half is secured within said tab slot of said second half, and said interlocking leaf of said second half is secured within said tab slot of said first half.

9. The container system of claim 8, further comprising:

said pan comprising a bottom face;

a pair of pan latches located on said pan bottom face, each one of said pair of pan latches comprising a pin connecting said respective latch to said bottom face of said pan whereby each of said pair of pan latches is rotatable about its respective said pin;

wherein a first of said pair of pan latches is configured to secure and lock said interlocking leaf of said first half within said tab slot of said second half, and wherein a second of said pair of pan latches is configured to secure and lock said interlocking leaf of said second half within said tab slot of said first half.

10. A method of deploying a collapsible container system, the method comprising the steps:

providing a container formed from a plurality of interlocking members, each interlocking member comprising a lower portion and an upper portion separated by a first bend of an angle between 45 degrees and 90 degrees;

wherein each of said plurality of interlocking members comprises a leading edge and a prevailing edge, whereby each respective said leading edge includes a locking tab;

wherein each of said plurality of interlocking members comprises a receiver slot in proximity to each respective said prevailing edge;

transforming said plurality of interlocking members from a first, collapsed orientation wherein said plurality of interlocking members form a stack of interlocking members, to a second, deployed orientation wherein said plurality of interlocking members fan out to form a container having an interior space defined by a container wall formed by the upper portions of said plurality of interlocking members and a container base formed by the lower portions of said plurality of interlocking members;

interlocking each said locking tab with a respective neighboring receiver slot, thereby securing said plurality of interlocking members in said second, deployed orientation; and placing a pan within said container base, wherein said pan comprises a base and a number of sides equaling the number of said plurality of interlocking members, said pan placed such that each corresponding side of said pan nests against a respective side of said plurality of interlocking members; and wherein at least two of each respective one of said plurality of interlocking members includes a respective a handle comprising a hole passing through said respective interlocking member, such that when said plurality of interlocking members is in said first, collapsed orientation, each respective hole is aligned.

11. The method of claim 10, further comprising the steps:

providing a respective latch located on an exterior face of each respective interlocking member in proximity with said receiver slot; and securing the respective locking tab within each respective receiver slot with each respective latch.

12. The method of claim 10, further comprising the steps:

forming said pan from a first half and a second half;

wherein said first half of said pan comprising an interlocking leaf and a tab slot;

said second half of said pan comprising an interlocking leaf and at a tab slot; and joining said first half and said second half of said pan by interlocking said at interlocking leaf of said first half with said interlocking leaf of said second half, such that said interlocking leaf of said first half is secured within said tab slot of said second half, and said interlocking leaf of said second half is secured within said tab slot of said first half.

13. The method of claim 12, further comprising the steps:

providing a pair of pan latches located on a bottom face of said pan;

wherein each one of said pair of pan latches comprising a pin connecting said respective latch to said bottom face of said pan whereby each of said pair of pan latches is rotatable about its respective said pin;

locking said interlocking leaf of said first half within said tab slot of said second half with a first of said pair of pan latches, and locking said interlocking leaf of said second half within said tab slot of said first half with a second of said pair of pan latches.

* * * * *